US008272893B2

(12) United States Patent
Burris et al.

(10) Patent No.: US 8,272,893 B2
(45) Date of Patent: Sep. 25, 2012

(54) INTEGRALLY CONDUCTIVE AND SHIELDED COAXIAL CABLE CONNECTOR

(75) Inventors: Donald Andrew Burris, Peoria, AZ (US); William Bernard Lutz, Glendale, AZ (US)

(73) Assignee: Corning Gilbert Inc., Wilmington, DE (US)

( * ) Notice: Subject to any disclaimer, the term of this patent is extended or adjusted under 35 U.S.C. 154(b) by 0 days.

(21) Appl. No.: 12/787,021

(22) Filed: May 25, 2010

(65) Prior Publication Data

US 2011/0117776 A1 May 19, 2011

Related U.S. Application Data

(60) Provisional application No. 61/261,541, filed on Nov. 16, 2009.

(51) Int. Cl.
*H01R 9/05* (2006.01)

(52) U.S. Cl. ..... 439/578

(58) Field of Classification Search ..... 439/578, 439/580, 582, 583, 584, 585
See application file for complete search history.

(56) References Cited

U.S. PATENT DOCUMENTS

| | | | | |
|---|---|---|---|---|
| 1,667,485 | A | 4/1928 | MacDonald | |
| 1,766,869 | A | 6/1930 | Austin | |
| 1,959,302 | A | 5/1934 | Paige | 174/47 |
| 2,258,737 | A | 10/1941 | Browne | 173/332 |
| 2,325,549 | A | 7/1943 | Ryzowitz | 174/110 |
| 2,480,963 | A | 9/1949 | Quinn | 173/328 |
| 2,544,654 | A | 3/1951 | Brown | 206/46 |
| 2,549,647 | A | 4/1951 | Turenne | 173/328 |
| 2,694,187 | A | 11/1954 | Nash | 339/14 |
| 2,754,487 | A | 7/1956 | Carr et al. | 339/102 |
| 2,755,331 | A | 7/1956 | Melcher | 174/87 |
| 2,757,351 | A | 7/1956 | Klostermann | 339/177 |
| 2,762,025 | A | 9/1956 | Melcher | 339/143 |
| 2,805,399 | A | 9/1957 | Leeper | 333/6 |
| 2,816,949 | A | 12/1957 | Curtiss | 174/51 |
| 2,870,420 | A | 1/1959 | Malek | 333/33 |
| 3,001,169 | A | 9/1961 | Blonder | 339/177 |
| 3,015,794 | A | 1/1962 | Kishbaugh | 339/14 |
| 3,091,748 | A | 5/1963 | Takes et al. | 339/65 |
| 3,094,364 | A | 6/1963 | Lingg | 339/64 |
| 3,184,706 | A | 5/1965 | Atkins | 339/177 |

(Continued)

FOREIGN PATENT DOCUMENTS

CA 2096710 11/1994

(Continued)

OTHER PUBLICATIONS

PCT International product brochure, HFC Network Division Connectors.

(Continued)

*Primary Examiner* — Ross Gushi
(74) *Attorney, Agent, or Firm* — Matthew J. Mason; John H. Vynalek

(57) ABSTRACT

The coaxial cable connector has a coupler, a post, and a ring that prevent interfaces from gapping and provide a robust alternative ground path that also RF shields the connector from both ingress and egress. The ring is disposed in between and engages at least a portion of a groove in the body and at least a portion of the channel in the coupler, radial movement of the coupler causes the axial movement of the body relative to the terminal.

7 Claims, 18 Drawing Sheets

U.S. PATENT DOCUMENTS

| | | | | |
|---|---|---|---|---|
| 3,196,382 | A | 7/1965 | Morello, Jr. | 339/177 |
| 3,245,027 | A | 4/1966 | Ziegler, Jr. | 339/89 |
| 3,275,913 | A | 9/1966 | Blanchard et al. | 317/249 |
| 3,278,890 | A | 10/1966 | Cooney | 339/256 |
| 3,281,757 | A | 10/1966 | Bonhomme | 339/91 |
| 3,292,136 | A | 12/1966 | Somerset et al. | 339/177 |
| 3,320,575 | A | 5/1967 | Brown et al. | 339/268 |
| 3,321,732 | A | 5/1967 | Forney, Jr. | 339/89 |
| 3,336,563 | A | 8/1967 | Hyslop | 339/61 |
| 3,348,186 | A | 10/1967 | Rosen | 338/214 |
| 3,350,677 | A | 10/1967 | Daum | 339/149 |
| 3,355,698 | A | 11/1967 | Keller | 339/97 |
| 3,373,243 | A | 3/1968 | Janowiak et al. | 174/89 |
| 3,390,374 | A | 6/1968 | Forney, Jr. | 339/177 |
| 3,406,373 | A | 10/1968 | Forney, Jr. | 339/97 |
| 3,448,430 | A | 6/1969 | Kelly | 339/143 |
| 3,453,376 | A | 7/1969 | Ziegler, Jr. et al. | 174/75 |
| 3,465,281 | A | 9/1969 | Florer | 339/89 |
| 3,475,545 | A | 10/1969 | Stark et al. | 174/88 |
| 3,498,647 | A | 3/1970 | Schroder | 285/343 |
| 3,517,373 | A | 6/1970 | Jamon | 339/94 |
| 3,533,051 | A | 10/1970 | Ziegler, Jr. | 339/177 |
| 3,537,065 | A | 10/1970 | Winston | 339/177 |
| 3,544,705 | A | 12/1970 | Winston | 174/75 |
| 3,551,882 | A | 12/1970 | O'Keefe | 339/177 |
| 3,564,487 | A | 2/1971 | Upstone et al. | 339/258 |
| 3,587,033 | A | 6/1971 | Brorein et al. | 339/89 |
| 3,601,776 | A | 8/1971 | Curl | 339/177 |
| 3,629,792 | A | 12/1971 | Dorrell | 339/60 M |
| 3,633,150 | A | 1/1972 | Swartz | 339/36 |
| 3,646,502 | A | 2/1972 | Hutter et al. | 339/89 |
| 3,663,926 | A | 5/1972 | Brandt | |
| 3,665,371 | A | 5/1972 | Cripps | 339/90 C |
| 3,668,612 | A | 6/1972 | Nepovim | 339/94 |
| 3,669,472 | A | 6/1972 | Nadsady | 285/87 |
| 3,671,922 | A | 6/1972 | Zerlin et al. | 339/74 R |
| 3,678,445 | A | 7/1972 | Brancaleone | 339/143 R |
| 3,680,034 | A | 7/1972 | Chow et al. | 339/48 |
| 3,681,739 | A | 8/1972 | Kornick | 339/94 C |
| 3,683,320 | A | 8/1972 | Woods et al. | 339/177 E |
| 3,686,623 | A | 8/1972 | Nijman | 339/177 E |
| 3,694,792 | A | 9/1972 | Wallo | 339/97 R |
| 3,706,958 | A | 12/1972 | Blanchenot | 339/177 E |
| 3,710,005 | A | 1/1973 | French | 174/89 |
| 3,739,076 | A | 6/1973 | Schwartz | 174/78 |
| 3,744,007 | A | 7/1973 | Horak | 339/97 R |
| 3,744,011 | A | 7/1973 | Blanchenot | 339/177 R |
| 3,778,535 | A | 12/1973 | Forney, Jr. | 174/88 C |
| 3,781,762 | A | 12/1973 | Quackenbush | 339/89 C |
| 3,781,898 | A | 12/1973 | Holloway | 343/872 |
| 3,783,178 | A | 1/1974 | Philibert et al. | 174/86 |
| 3,793,610 | A | 2/1974 | Brishka | 339/74 R |
| 3,798,589 | A | 3/1974 | Deardurff | 339/223 S |
| 3,808,580 | A | 4/1974 | Johnson | 339/89 R |
| 3,810,076 | A | 5/1974 | Hutter | 339/177 R |
| 3,835,443 | A | 9/1974 | Arnold et al. | 339/90 R |
| 3,836,700 | A | 9/1974 | Niemeyer | 174/89 |
| 3,845,453 | A | 10/1974 | Hemmer | 339/59 R |
| 3,846,738 | A | 11/1974 | Nepovim | 339/177 R |
| 3,854,003 | A | 12/1974 | Duret | 174/88 C |
| 3,858,156 | A | 12/1974 | Zarro | 339/32 |
| 3,879,102 | A | 4/1975 | Horak | 339/143 R |
| 3,886,301 | A | 5/1975 | Cronin et al. | 174/21 C |
| 3,907,399 | A | 9/1975 | Spinner | 339/177 R |
| 3,910,673 | A | 10/1975 | Stokes | 339/177 R |
| 3,915,539 | A | 10/1975 | Collins | 339/94 C |
| 3,936,132 | A | 2/1976 | Hutter | 339/130 C |
| 3,953,097 | A | 4/1976 | Graham | 339/37 |
| 3,963,320 | A | 6/1976 | Spinner | 339/177 R |
| 3,963,321 | A | 6/1976 | Burger et al. | 339/177 E |
| 3,970,355 | A | 7/1976 | Pitschi | 339/177 R |
| 3,972,013 | A | 7/1976 | Shapiro | 333/97 R |
| 3,976,352 | A | 8/1976 | Spinner | 339/177 R |
| 3,980,805 | A | 9/1976 | Lipari | 174/88 C |
| 3,985,418 | A | 10/1976 | Spinner | 339/177 R |
| 4,017,139 | A | 4/1977 | Nelson | 339/91 R |
| 4,022,966 | A | 5/1977 | Gajajiva | 174/65 |
| 4,030,798 | A | 6/1977 | Paoli | 339/89 R |
| 4,046,451 | A | 9/1977 | Juds et al. | 339/177 R |
| 4,053,200 | A | 10/1977 | Pugner | 339/177 R |
| 4,059,330 | A | 11/1977 | Shirey | 339/177 R |
| 4,079,343 | A | 3/1978 | Nijman | 333/79 |
| 4,082,404 | A | 4/1978 | Flatt | 339/111 |
| 4,090,028 | A | 5/1978 | Vontobel | 174/14 R |
| 4,093,335 | A | 6/1978 | Schwartz et al. | 339/177 E |
| 4,106,839 | A | 8/1978 | Cooper | 339/143 R |
| 4,125,308 | A | 11/1978 | Schilling | 339/17 LC |
| 4,126,372 | A | 11/1978 | Hashimoto et al. | 339/177 E |
| 4,131,332 | A | 12/1978 | Hogendobler et al. | 339/177 R |
| 4,150,250 | A | 4/1979 | Lundeberg | 174/65 SS |
| 4,153,320 | A | 5/1979 | Townshend | 339/91 B |
| 4,156,554 | A | 5/1979 | Aujla | 339/177 R |
| 4,165,911 | A | 8/1979 | Laudig | 339/89 C |
| 4,168,921 | A | 9/1979 | Blanchard | 403/19 |
| 4,173,385 | A | 11/1979 | Fenn et al. | 339/177 E |
| 4,174,875 | A | 11/1979 | Wilson et al. | 339/91 P |
| 4,187,481 | A | 2/1980 | Boutros | 333/182 |
| 4,193,655 | A | 3/1980 | Herrmann, Jr. | 339/31 R |
| 4,225,162 | A | 9/1980 | Dola | 285/161 |
| 4,227,765 | A | 10/1980 | Neumann et al. | 339/143 R |
| 4,229,714 | A | 10/1980 | Yu | 333/12 |
| 4,250,348 | A | 2/1981 | Kitagawa | 174/65 SS |
| 4,273,405 | A | 6/1981 | Law | 439/462 |
| 4,280,749 | A | 7/1981 | Hemmer | 339/177 R |
| 4,285,564 | A | 8/1981 | Spinner | 339/89 C |
| 4,290,663 | A | 9/1981 | Fowler et al. | 339/143 R |
| 4,296,986 | A | 10/1981 | Herrmann, Jr. | 439/322 |
| 4,307,926 | A | 12/1981 | Smith | 339/177 R |
| 4,322,121 | A | 3/1982 | Riches et al. | 339/89 M |
| 4,326,769 | A | 4/1982 | Dorsey et al. | 339/177 E |
| 4,339,166 | A | 7/1982 | Dayton | 339/100 |
| 4,346,958 | A | 8/1982 | Blanchard | 339/177 R |
| 4,354,721 | A | 10/1982 | Luzzi | 339/94 R |
| 4,358,174 | A | 11/1982 | Dreyer | 339/64 M |
| 4,373,767 | A | 2/1983 | Cairns | 339/94 C |
| 4,389,081 | A | 6/1983 | Gallusser et al. | 339/89 M |
| 4,400,050 | A | 8/1983 | Hayward | 339/117 R |
| 4,407,529 | A | 10/1983 | Holman | 285/82 |
| 4,408,821 | A | 10/1983 | Forney, Jr. | 339/177 R |
| 4,408,822 | A | 10/1983 | Nikitas | 439/583 |
| 4,412,717 | A | 11/1983 | Monroe | 339/177 R |
| 4,421,377 | A | 12/1983 | Spinner | 339/177 R |
| 4,426,127 | A | 1/1984 | Kubota | 339/177 R |
| 4,444,453 | A | 4/1984 | Kirby et al. | 339/177 R |
| 4,452,503 | A | 6/1984 | Forney, Jr. | 339/177 R |
| 4,456,323 | A | 6/1984 | Pitcher et al. | 339/177 R |
| 4,462,653 | A | 7/1984 | Flederbach et al. | 339/89 R |
| 4,464,000 | A | 8/1984 | Werth et al. | 339/89 M |
| 4,464,001 | A | 8/1984 | Collins | 339/90 R |
| 4,469,386 | A | 9/1984 | Ackerman | 339/37 |
| 4,470,657 | A | 9/1984 | Deacon | 339/143 R |
| 4,484,792 | A | 11/1984 | Tengler et al. | 339/143 R |
| 4,484,796 | A | 11/1984 | Sato et al. | 350/96.21 |
| 4,506,943 | A | 3/1985 | Drogo | 339/90 R |
| 4,515,427 | A | 5/1985 | Smit | 339/177 E |
| 4,525,017 | A | 6/1985 | Schildkraut et al. | 339/89 M |
| 4,531,805 | A | 7/1985 | Werth | 339/143 R |
| 4,533,191 | A | 8/1985 | Blackwood | 339/31 R |
| 4,540,231 | A | 9/1985 | Forney, Jr. | 339/94 C |
| RE31,995 | E | 10/1985 | Ball | 339/113 R |
| 4,545,637 | A | 10/1985 | Bosshard et al. | 339/177 E |
| 4,575,274 | A | 3/1986 | Hayward | 403/2 |
| 4,580,862 | A | 4/1986 | Johnson | 339/64 R |
| 4,580,865 | A | 4/1986 | Fryberger | 339/103 M |
| 4,583,811 | A | 4/1986 | McMills | 339/177 R |
| 4,585,289 | A | 4/1986 | Bocher | 339/89 C |
| 4,588,246 | A | 5/1986 | Schildkraut et al. | 339/89 R |
| 4,593,964 | A | 6/1986 | Forney, Jr. et al. | 339/177 R |
| 4,596,434 | A | 6/1986 | Saba et al. | 339/177 R |
| 4,596,435 | A | 6/1986 | Bickford | 339/177 R |
| 4,598,961 | A | 7/1986 | Cohen | 339/17 C |
| 4,600,263 | A | 7/1986 | DeChamp et al. | 339/177 R |
| 4,613,199 | A | 9/1986 | McGeary | 339/177 R |
| 4,614,390 | A | 9/1986 | Baker | 339/61 R |
| 4,616,900 | A | 10/1986 | Cairns | 350/96.2 |
| 4,632,487 | A | 12/1986 | Wargula | 339/103 B |
| 4,634,213 | A | 1/1987 | Larsson et al. | 339/275 T |

4,640,572 A 2/1987 Conlon ..... 339/252 R
4,645,281 A 2/1987 Burger ..... 339/37
4,647,135 A 3/1987 Reinhardt ..... 439/460
4,650,228 A 3/1987 McMills et al. ..... 285/381
4,655,159 A 4/1987 McMills ..... 116/212
4,655,534 A 4/1987 Stursa ..... 339/177 R
4,660,921 A 4/1987 Hauver ..... 339/117 R
4,668,043 A 5/1987 Saba et al. ..... 339/177 R
4,674,818 A 6/1987 McMills et al. ..... 439/275
4,676,577 A 6/1987 Szegda ..... 439/584
4,682,832 A 7/1987 Punako et al. ..... 439/589
4,684,201 A 8/1987 Hutter ..... 439/585
4,688,876 A 8/1987 Morelli ..... 439/578
4,688,878 A 8/1987 Cohen et al. ..... 439/585
4,691,976 A 9/1987 Cowen ..... 439/394
4,703,987 A 11/1987 Gallusser et al. ..... 439/595
4,703,988 A 11/1987 Raux et al. ..... 439/321
4,717,355 A 1/1988 Mattis ..... 439/452
4,720,155 A 1/1988 Schildkraut et al. ..... 439/108
4,734,050 A 3/1988 Negre et al. ..... 439/289
4,734,666 A 3/1988 Ohya et al. ..... 333/230
4,737,123 A 4/1988 Paler et al. ..... 439/607
4,738,009 A 4/1988 Down et al. ..... 29/33 M
4,738,628 A 4/1988 Rees ..... 439/95
4,746,305 A 5/1988 Nomura ..... 439/319
4,747,786 A 5/1988 Hayashi et al. ..... 439/95
4,749,821 A 6/1988 Linton et al. ..... 174/35 R
4,755,152 A 7/1988 Elliot et al. ..... 439/452
4,757,297 A 7/1988 Frawley ..... 338/214
4,759,729 A 7/1988 Kemppainen et al. ..... 439/580
4,761,146 A 8/1988 Sohoel ..... 439/584
4,772,222 A 9/1988 Laudig et al. ..... 439/578
4,789,355 A 12/1988 Lee ..... 439/584
4,806,116 A 2/1989 Ackerman ..... 439/304
4,807,891 A 2/1989 Neher ..... 277/80
4,808,128 A 2/1989 Werth ..... 439/610
4,813,886 A 3/1989 Roos et al. ..... 439/578
4,820,185 A 4/1989 Moulin ..... 439/321
4,834,675 A 5/1989 Samchisen ..... 439/578
4,835,342 A 5/1989 Guginsky ..... 174/65 SS
4,836,801 A 6/1989 Ramirez ..... 439/322
4,838,813 A 6/1989 Pauza et al. ..... 439/620
4,854,893 A 8/1989 Morris ..... 439/578
4,857,014 A 8/1989 Alf et al. ..... 439/578
4,867,706 A 9/1989 Tang ..... 439/620
4,869,679 A 9/1989 Szegda ..... 439/272
4,874,331 A 10/1989 Iverson ..... 439/449
4,892,275 A 1/1990 Szegda ..... 248/61
4,902,246 A 2/1990 Samchisen ..... 439/578
4,906,207 A 3/1990 Banning et al. ..... 439/578
4,915,651 A 4/1990 Bout ..... 439/578
4,921,447 A 5/1990 Capp et al. ..... 439/585
4,923,412 A 5/1990 Morris ..... 439/578
4,925,403 A 5/1990 Zorzy ..... 439/578
4,927,385 A 5/1990 Cheng ..... 439/578
4,929,188 A 5/1990 Lionetto et al. ..... 439/349
4,938,718 A 7/1990 Guendel ..... 439/680
4,941,846 A 7/1990 Guimond et al. ..... 439/578
4,952,174 A 8/1990 Sucht et al. ..... 439/584
4,957,456 A 9/1990 Olson et al. ..... 439/578
4,973,265 A 11/1990 Heeren ..... 439/584
4,979,911 A 12/1990 Spencer ..... 439/583
4,990,104 A 2/1991 Schieferly ..... 439/578
4,990,105 A 2/1991 Karlovich ..... 439/578
4,990,106 A 2/1991 Szegda ..... 439/585
4,992,061 A 2/1991 Brush, Jr. et al. ..... 439/620
5,002,503 A 3/1991 Campbell et al. ..... 439/578
5,007,861 A 4/1991 Stirling ..... 439/578
5,011,422 A 4/1991 Yeh ..... 439/307
5,011,432 A 4/1991 Sucht et al. ..... 439/584
5,021,010 A 6/1991 Wright ..... 439/578
5,024,606 A 6/1991 Ming-Hwa ..... 439/578
5,030,126 A 7/1991 Hanlon ..... 439/320
5,037,328 A 8/1991 Karlovich ..... 439/578
5,046,964 A 9/1991 Welsh et al. ..... 439/271
5,052,947 A 10/1991 Brodie et al. ..... 439/607
5,055,060 A 10/1991 Down et al. ..... 439/304
5,059,747 A 10/1991 Bawa et al. ..... 174/65
5,062,804 A 11/1991 Jamet et al. ..... 439/394
5,066,248 A 11/1991 Gaver, Jr. et al. ..... 439/578
5,073,129 A 12/1991 Szegda ..... 439/585
5,080,600 A 1/1992 Baker et al. ..... 439/258
5,083,943 A 1/1992 Tarrant ..... 439/583
5,120,260 A 6/1992 Jackson ..... 439/585
5,127,853 A 7/1992 McMills et al. ..... 439/578
5,131,862 A 7/1992 Gershfeld ..... 439/357
5,137,470 A 8/1992 Doles ..... 439/578
5,137,471 A 8/1992 Verespej et al. ..... 439/585
5,141,448 A 8/1992 Mattingly et al. ..... 439/314
5,141,451 A 8/1992 Down ..... 439/585
5,149,274 A 9/1992 Gallusser et al. ..... 439/76
5,154,636 A 10/1992 Vaccaro et al. ..... 439/583
5,161,993 A 11/1992 Leibfried, Jr. ..... 439/320
5,166,477 A 11/1992 Perin, Jr. et al. ..... 174/74 R
5,167,545 A 12/1992 O'Brien et al. ..... 439/874
5,169,323 A 12/1992 Kawai et al. ..... 439/95
5,181,161 A 1/1993 Hirose et al. ..... 369/48
5,183,417 A 2/1993 Bools ..... 439/610
5,186,501 A 2/1993 Mano ..... 285/89
5,186,655 A 2/1993 Glenday et al. ..... 439/583
5,195,905 A 3/1993 Pesci ..... 439/352
5,195,906 A 3/1993 Szegda ..... 439/394
5,205,547 A 4/1993 Mattingly ..... 267/158
5,205,761 A 4/1993 Nilsson ..... 439/578
5,207,602 A 5/1993 McMills et al. ..... 439/836
5,215,477 A 6/1993 Weber et al. ..... 439/581
5,217,391 A 6/1993 Fisher, Jr. ..... 439/578
5,217,393 A 6/1993 Del Negro et al. ..... 439/585
5,227,587 A 7/1993 Paterek ..... 174/152 GM
5,247,424 A 9/1993 Harris et al. ..... 361/704
5,269,701 A 12/1993 Leibfried, Jr. ..... 439/578
5,281,762 A 1/1994 Long et al. ..... 174/78
5,283,853 A 2/1994 Szegda ..... 385/139
5,284,449 A 2/1994 Vaccaro ..... 439/583
5,294,864 A 3/1994 Do ..... 315/39.51
5,295,864 A 3/1994 Birch et al. ..... 439/578
5,316,494 A 5/1994 Flanagan et al. ..... 439/352
5,318,459 A 6/1994 Shields ..... 439/527
5,334,032 A 8/1994 Myers et al. ..... 439/140
5,334,051 A 8/1994 Devine et al. ..... 439/583
5,338,225 A 8/1994 Jacobsen et al. ..... 439/585
5,342,218 A 8/1994 McMills et al. ..... 439/578
5,354,217 A 10/1994 Gabel et al. ..... 439/583
5,362,250 A 11/1994 McMills et al. ..... 439/387
5,371,819 A 12/1994 Szegda ..... 385/75
5,371,821 A 12/1994 Szegda ..... 385/87
5,371,827 A 12/1994 Szegda ..... 385/136
5,380,211 A 1/1995 Kawaguchi et al. ..... 439/74
5,389,005 A 2/1995 Kodama ..... 439/272
5,393,244 A 2/1995 Szegda ..... 439/394
5,413,504 A 5/1995 Kloecker et al. ..... 439/620
5,431,583 A 7/1995 Szegda ..... 439/589
5,435,745 A 7/1995 Booth ..... 439/584
5,435,751 A 7/1995 Papenheim et al. ..... 439/589
5,439,386 A 8/1995 Ellis et al. ..... 439/322
5,444,810 A 8/1995 Szegda ..... 385/139
5,455,548 A 10/1995 Grandchamp et al. ..... 333/260
5,456,611 A 10/1995 Henry et al. ..... 439/180
5,456,614 A 10/1995 Szegda ..... 439/321
5,466,173 A 11/1995 Down ..... 439/584
5,470,257 A 11/1995 Szegda ..... 439/578
5,474,478 A 12/1995 Ballog ..... 439/805
5,490,801 A 2/1996 Fisher, Jr. et al. ..... 439/585
5,494,454 A 2/1996 Johnsen ..... 439/394
5,499,934 A 3/1996 Jacobsen et al. ..... 439/585
5,501,616 A 3/1996 Holliday ..... 439/585
5,516,303 A 5/1996 Yohn et al. ..... 439/248
5,525,076 A 6/1996 Down ..... 439/585
5,542,861 A 8/1996 Anhalt et al. ..... 439/578
5,548,088 A 8/1996 Gray et al. ..... 174/74 R
5,550,521 A 8/1996 Bernaud et al. ..... 333/260
5,564,938 A 10/1996 Shenkal et al. ..... 439/301
5,571,028 A 11/1996 Szegda ..... 439/322
5,586,910 A 12/1996 Del Negro et al. ..... 439/584
5,595,499 A 1/1997 Zander et al. ..... 439/352
5,598,132 A 1/1997 Stabile ..... 333/22 R
5,607,325 A 3/1997 Toma ..... 439/578
5,620,339 A 4/1997 Gray et al. ..... 439/578

5,632,637 A 5/1997 Diener ..... 439/188
5,632,651 A 5/1997 Szegda ..... 439/578
5,644,104 A 7/1997 Porter et al. ..... 174/65 R
5,651,698 A 7/1997 Locati et al. ..... 439/578
5,651,699 A 7/1997 Holliday ..... 439/585
5,653,605 A 8/1997 Woehl et al. ..... 439/321
5,667,405 A 9/1997 Holliday ..... 439/585
5,681,172 A 10/1997 Moldenhauer ..... 439/95
5,683,263 A 11/1997 Hsu ..... 439/319
5,702,263 A 12/1997 Baumann et al. ..... 439/321
5,722,856 A 3/1998 Fuchs et al. ..... 439/578
5,735,704 A 4/1998 Anthony ..... 439/271
5,746,617 A 5/1998 Porter, Jr. et al. ..... 439/248
5,746,619 A 5/1998 Harting et al. ..... 439/352
5,769,652 A 6/1998 Wider ..... 439/248
5,775,927 A 7/1998 Wider ..... 439/188
5,802,710 A * 9/1998 Bufanda et al. ..... 29/828
5,863,220 A 1/1999 Holliday ..... 439/584
5,877,452 A 3/1999 McConnell ..... 174/88 C
5,879,191 A 3/1999 Burris ..... 439/584
5,882,226 A 3/1999 Bell et al. ..... 439/582
5,921,793 A 7/1999 Phillips ..... 439/188
5,938,465 A 8/1999 Fox, Sr. ..... 439/350
5,944,548 A 8/1999 Saito ..... 439/248
5,951,327 A 9/1999 Marik ..... 439/610
5,957,716 A 9/1999 Buckley et al. ..... 439/321
5,967,852 A 10/1999 Follingstad et al. ..... 439/675
5,975,949 A 11/1999 Holliday et al. ..... 439/585
5,975,951 A 11/1999 Burris et al. ..... 439/585
5,977,841 A 11/1999 Lee et al. ..... 333/24 C
5,997,350 A 12/1999 Burris et al. ..... 439/585
6,010,349 A 1/2000 Porter, Jr. ..... 439/320
6,019,635 A 2/2000 Nelson ..... 439/583
6,022,237 A 2/2000 Esh ..... 439/348
6,032,358 A 3/2000 Wild ..... 29/863
6,042,422 A 3/2000 Youtsey ..... 439/585
6,048,229 A 4/2000 Lazaro, Jr. ..... 439/681
6,053,743 A 4/2000 Mitchell et al. ..... 439/63
6,053,769 A 4/2000 Kubota et al. ..... 439/578
6,053,777 A 4/2000 Boyle ..... 439/700
6,083,053 A 7/2000 Anderson, Jr. et al. ..... 439/687
6,089,903 A 7/2000 Stafford Gray et al. ..... 439/439
6,089,912 A 7/2000 Tallis et al. ..... 439/584
6,089,913 A 7/2000 Holliday ..... 439/584
6,123,567 A 9/2000 McCarthy ..... 439/427
6,146,197 A 11/2000 Holliday et al. ..... 439/585
6,152,753 A 11/2000 Johnson et al. ..... 439/321
6,153,830 A 11/2000 Montena ..... 174/88 C
6,210,216 B1 4/2001 Tso-Chin et al. ..... 439/545
6,210,222 B1 4/2001 Langham et al. ..... 439/583
6,217,383 B1 4/2001 Holland et al. ..... 439/578
6,239,359 B1 5/2001 Lilienthal, II et al. ... 174/35 GC
6,241,553 B1 6/2001 Hsia ..... 439/578
6,257,923 B1 7/2001 Stone et al. ..... 439/502
6,261,126 B1 7/2001 Stirling ..... 439/583
6,271,464 B1 8/2001 Cunningham ..... 174/35 R
6,331,123 B1 12/2001 Rodrigues ..... 439/584
6,332,815 B1 12/2001 Bruce ..... 439/862
6,358,077 B1 3/2002 Young ..... 439/321
D458,904 S 6/2002 Montena ..... D13/154
6,406,330 B2 6/2002 Bruce ..... 439/609
D460,739 S 7/2002 Fox ..... D13/154
D460,740 S 7/2002 Montena ..... D13/154
D460,946 S 7/2002 Montena ..... D13/154
D460,947 S 7/2002 Montena ..... D13/154
D460,948 S 7/2002 Montena ..... D13/154
6,422,900 B1 7/2002 Hogan ..... 439/578
6,425,782 B1 7/2002 Holland ..... 439/585
D461,166 S 8/2002 Montena ..... D13/151
D461,167 S 8/2002 Montena ..... D13/154
D461,778 S 8/2002 Fox ..... D13/151
D462,058 S 8/2002 Montena ..... D13/151
D462,060 S 8/2002 Fox ..... D13/154
6,439,899 B1 8/2002 Muzslay et al. ..... 439/98
D462,327 S 9/2002 Montena ..... D13/151
6,468,100 B1 10/2002 Meyer et al. ..... 439/320
6,491,546 B1 12/2002 Perry ..... 439/620
D468,696 S 1/2003 Montena ..... D13/151
6,506,083 B1 1/2003 Bickford et al. ..... 439/736
6,520,800 B1 2/2003 Michelbach et al. ..... 439/578
6,530,807 B2 3/2003 Rodrigues et al. ..... 439/578
6,540,531 B2 4/2003 Syed et al. ..... 439/98
6,558,194 B2 5/2003 Montena ..... 439/585
6,572,419 B2 6/2003 Feye-Homann ..... 439/839
6,576,833 B2 6/2003 Twiss et al. ..... 174/35 GC
6,619,876 B2 9/2003 Vaitkus et al. ..... 403/349
6,676,446 B2 1/2004 Montena ..... 439/583
6,683,253 B1 1/2004 Lee ..... 174/75
6,692,285 B2 2/2004 Islam ..... 439/352
6,705,884 B1 3/2004 McCarthy ..... 439/394
6,712,631 B1 3/2004 Youtsey ..... 439/322
6,716,041 B2 4/2004 Ferderer et al. ..... 439/95
6,716,062 B1 4/2004 Palinkas et al. ..... 439/578
6,733,336 B1 5/2004 Montena et al. ..... 439/578
6,733,337 B2 5/2004 Kodaira ..... 439/578
6,752,633 B2 6/2004 Aizawa et al. ..... 439/63
6,767,248 B1 7/2004 Hung ..... 439/578
6,780,068 B2 8/2004 Bartholoma et al. ..... 439/752
6,786,767 B1 9/2004 Fuks et al. ..... 439/578
6,790,081 B2 9/2004 Burris et al. ..... 439/578
6,805,584 B1 10/2004 Chen ..... 439/578
6,817,896 B2 11/2004 Derenthal ..... 439/578
6,848,939 B2 2/2005 Stirling ..... 439/578
6,848,940 B2 2/2005 Montena ..... 439/584
6,848,941 B2 2/2005 Wlos et al. ..... 439/585
6,884,113 B1 4/2005 Montena ..... 439/578
6,884,115 B2 4/2005 Malloy ..... 439/584
6,929,265 B2 8/2005 Holland et al. ..... 277/622
6,929,508 B1 8/2005 Holland ..... 439/579
6,939,169 B2 9/2005 Islam et al. ..... 439/578
6,948,976 B2 9/2005 Goodwin et al. ..... 439/578
6,971,912 B2 12/2005 Montena et al. ..... 439/578
7,029,326 B2 4/2006 Montena ..... 439/585
7,070,477 B2 7/2006 Morisawa et al. ..... 451/5
7,086,897 B2 8/2006 Montena ..... 439/578
7,097,499 B1 8/2006 Purdy ..... 439/578
7,102,868 B2 9/2006 Montena ..... 361/119
7,114,990 B2 10/2006 Bence et al. ..... 439/583
7,118,416 B2 10/2006 Montena et al. ..... 439/584
7,125,283 B1 10/2006 Lin ..... 439/578
7,131,868 B2 11/2006 Montena ..... 439/578
7,144,271 B1 12/2006 Burris et al. ..... 439/578
7,147,509 B1 12/2006 Burris et al. ..... 439/578
7,156,696 B1 1/2007 Montena ..... 439/584
7,161,785 B2 1/2007 Chawgo ..... 361/119
7,229,303 B2 6/2007 Vermoesen et al. ..... 439/271
7,252,546 B1 8/2007 Holland et al. ..... 439/584
7,255,598 B2 8/2007 Montena et al. ..... 439/578
7,299,550 B2 11/2007 Montena ..... 29/857
7,375,533 B2 5/2008 Gale ..... 324/538
7,393,245 B2 7/2008 Palinkas et al. ..... 439/620.03
7,452,239 B2 11/2008 Montena ..... 439/620.03
7,455,550 B1 11/2008 Sykes ..... 439/584
7,462,068 B2 12/2008 Amidon ..... 439/578
7,476,127 B1 1/2009 Wei ..... 439/583
7,479,035 B2 1/2009 Bence et al. ..... 439/583
7,488,210 B1 2/2009 Burris et al. ..... 439/578
7,494,355 B2 2/2009 Hughes et al. ..... 439/181
7,497,729 B1 3/2009 Wei ..... 439/578
7,507,117 B2 3/2009 Amidon ..... 439/584
7,544,094 B1 6/2009 Paglia et al. ..... 439/585
7,566,236 B2 7/2009 Malloy et al. ..... 439/321
7,607,942 B1 10/2009 Van Swearingen ..... 439/578
7,674,132 B1 3/2010 Chen ..... 439/578
7,682,177 B2 3/2010 Berthet ..... 439/321
7,727,011 B2 6/2010 Montena et al. ..... 439/578
7,753,705 B2 7/2010 Montena ..... 439/277
7,794,275 B2 9/2010 Rodrigues ..... 439/584
7,806,725 B1 10/2010 Chen ..... 439/578
7,811,133 B2 10/2010 Gray ..... 439/607.41
7,824,216 B2 11/2010 Purdy ..... 439/578
7,828,595 B2 11/2010 Mathews ..... 439/578
7,830,154 B2 11/2010 Gale ..... 324/538
7,833,053 B2 11/2010 Mathews ..... 439/578
7,845,976 B2 12/2010 Mathews ..... 439/578
7,845,978 B1 12/2010 Chen ..... 439/578
7,850,487 B1 12/2010 Wei ..... 439/578
7,857,661 B1 12/2010 Islam ..... 439/584

| | | | | |
|---|---|---|---|---|
| 7,874,870 | B1 | 1/2011 | Chen | 439/582 |
| 7,887,354 | B2 | 2/2011 | Holliday | 439/321 |
| 7,892,005 | B2 | 2/2011 | Haube | 439/321 |
| 7,892,024 | B1 | 2/2011 | Chen | 439/578 |
| 7,927,135 | B1 | 4/2011 | Wlos | 439/584 |
| 7,950,958 | B2 | 5/2011 | Mathews | 439/578 |
| 7,955,126 | B2 | 6/2011 | Bence et al. | 439/583 |
| 8,029,315 | B2 | 10/2011 | Purdy et al. | 439/578 |
| 8,062,044 | B2 | 11/2011 | Montena et al. | 439/277 |
| 8,075,338 | B1 | 12/2011 | Montena | 439/578 |
| 8,079,860 | B1 | 12/2011 | Zraik | 439/255 |
| 2002/0013088 | A1 | 1/2002 | Rodrigues et al. | 439/578 |
| 2002/0038720 | A1 | 4/2002 | Kai et al. | 174/125.1 |
| 2002/0146935 | A1 | 10/2002 | Wong | 439/583 |
| 2003/0214370 | A1 | 11/2003 | Allison et al. | 333/182 |
| 2004/0077215 | A1 | 4/2004 | Palinkas et al. | 439/578 |
| 2004/0102089 | A1 | 5/2004 | Chee | 439/578 |
| 2004/0209516 | A1 | 10/2004 | Burris et al. | 439/587 |
| 2004/0219833 | A1 | 11/2004 | Burris et al. | 439/578 |
| 2004/0229504 | A1 | 11/2004 | Liu | 439/578 |
| 2005/0042919 | A1 | 2/2005 | Montena | 439/578 |
| 2005/0170692 | A1 | 8/2005 | Montena | 439/578 |
| 2005/0181652 | A1 | 8/2005 | Montena et al. | 439/271 |
| 2005/0181668 | A1 | 8/2005 | Montena et al. | 439/578 |
| 2005/0208827 | A1 | 9/2005 | Burris et al. | 439/578 |
| 2006/0014425 | A1 | 1/2006 | Montena | 439/578 |
| 2006/0110977 | A1 | 5/2006 | Matthews | 439/578 |
| 2006/0154519 | A1 | 7/2006 | Montena | 439/578 |
| 2006/0166552 | A1 | 7/2006 | Bence et al. | 439/578 |
| 2006/0178046 | A1 | 8/2006 | Tusini | 439/578 |
| 2007/0026734 | A1 | 2/2007 | Bence et al. | 439/583 |
| 2007/0123101 | A1 | 5/2007 | Palinkas | 439/579 |
| 2008/0102696 | A1 | 5/2008 | Montena | 439/578 |
| 2009/0029590 | A1 | 1/2009 | Sykes et al. | 439/585 |
| 2009/0098770 | A1 | 4/2009 | Bence et al. | 439/583 |
| 2010/0081321 | A1 | 4/2010 | Malloy et al. | 439/578 |
| 2010/0081322 | A1 | 4/2010 | Malloy et al. | 439/578 |
| 2010/0105246 | A1 | 4/2010 | Burris et al. | 439/578 |
| 2010/0255721 | A1 | 10/2010 | Purdy et al. | 439/583 |
| 2010/0279548 | A1 | 11/2010 | Montena et al. | 439/620.04 |
| 2010/0297871 | A1 | 11/2010 | Haube | 439/489 |
| 2010/0297875 | A1 | 11/2010 | Purdy et al. | 439/578 |
| 2011/0021072 | A1 | 1/2011 | Purdy | 439/578 |
| 2011/0053413 | A1 | 3/2011 | Mathews | 439/578 |
| 2011/0117774 | A1 | 5/2011 | Malloy et al. | 439/578 |
| 2011/0143567 | A1 | 6/2011 | Purdy et al. | 439/277 |
| 2011/0230089 | A1 | 9/2011 | Amidon et al. | 439/578 |
| 2011/0230091 | A1 | 9/2011 | Krenceski et al. | 439/578 |
| 2012/0021642 | A1 | 1/2012 | Zraik | 439/578 |

FOREIGN PATENT DOCUMENTS

| | | | |
|---|---|---|---|
| CN | 201149936 | Y | 11/2008 |
| CN | 201149937 | Y | 11/2008 |
| CN | 201178228 | Y | 1/2009 |
| CN | 201904508 | | 7/2011 |
| DE | 47931 | | 10/1888 |
| DE | 102289 | | 4/1899 |
| DE | 1515398 | | 4/1970 |
| DE | 2225764 | | 12/1972 |
| DE | 2221936 | | 11/1973 |
| DE | 2261973 | | 6/1974 |
| DE | 3211008 | A1 | 10/1983 |
| DE | 9001608 | | 4/1990 |
| DE | 4439852 | | 5/1996 |
| EP | 0072104 | A1 | 2/1983 |
| EP | 0116157 | A1 | 8/1984 |
| EP | 0167738 | A2 | 1/1986 |
| EP | 0265276 | A2 | 4/1988 |
| EP | 0428424 | A2 | 5/1991 |
| EP | 1191268 | A1 | 3/2002 |
| EP | 1501159 | A1 | 1/2005 |
| EP | 1701410 | A2 | 9/2006 |
| FR | 2232846 | A1 | 1/1975 |
| FR | 2234680 | A2 | 1/1975 |
| FR | 2312918 | | 12/1976 |
| FR | 2462798 AI | | 2/1981 |
| FR | 2494508 | A1 | 5/1982 |
| GB | 589697 | | 6/1947 |
| GB | 1087228 | | 10/1967 |
| GB | 1270846 | | 4/1972 |
| GB | 1401373 | | 7/1975 |
| GB | 2019665 | A | 10/1979 |
| GB | 2079549 | A | 1/1982 |
| GB | 2252677 | A | 8/1992 |
| GB | 2264201 | A | 8/1993 |
| GB | 2331634 | A | 5/1999 |
| GB | 2477479 | A | 11/2010 |
| KR | 100622526 | | 9/2006 |
| TW | 427044 | | 3/2001 |
| WO | 87/00351 | | 1/1987 |
| WO | 02/069457 | | 9/2002 |
| WO | 2004/013883 | A2 | 2/2004 |
| WO | 01/86756 | A1 | 11/2005 |
| WO | 2006/081141 | A1 | 8/2006 |
| WO | 2010/135181 | A2 | 11/2010 |

OTHER PUBLICATIONS

US Department of the Army Tech Manual TM 9-1819AC, pp. 284-285.

US Department of the Army Tech Manual TM 9-8024, pp. 418-419.

* cited by examiner

INTEGRALLY CONDUCTIVE AND SHIELDED COAXIAL CABLE CONNECTOR

CROSS-REFERENCE TO RELATED APPLICATIONS

This application claims the benefit of, and priority to U.S. Provisional Patent Application No. 61/261,541 filed on Nov. 16, 2009 entitled, "Integrally Conductive and Shielded Coaxial Cable Connector", the content of which is relied upon and incorporated herein by reference in its entirety.

BACKGROUND OF THE INVENTION

1. Field of the Invention

The present invention relates generally to coaxial cable connectors, and particularly to coaxial cable connectors capable of securely connecting a coaxial cable to a terminal.

2. Technical Background

With the advent of digital signal in CATV systems, a rise in customer complaints due to poor picture quality in the form of signal interference resulting in what is known as "tiling" and the like has also occurred. Complaints of this nature result in CATV system operators having to send a technician to address the issue. Frequently it is reported by the technician that the cause of the problem is a loose F-connector fitting. Type F-connector fittings may be loose for many reasons; sometimes they are not properly tightened due to installation rules of system operators that prohibit the use of wrenches in-doors on customer equipment. Other times a homeowner may relocate equipment after the technician departs and may not adequately secure the F connectors. Additionally, some claim that F-connector couplers loosen due to vibration and/or heat and cold cycles.

Regardless, an improperly installed connector may result in poor signal transfer because there are discontinuities along the electrical path between the devices, resulting in a leak of radio frequency ("RF") signal. That leak may be in the form of signal egress where the RF energy radiates out of the connector/cable arrangement. Alternately, an RF leak may be in the form of signal ingress where RF energy from an external source or sources may enter the connector/cable arrangement causing a signal to noise ratio problem resulting in an unacceptable picture.

Many of the current state of the art F connectors rely on intimate contact between the F male connector interface and the F female connector interface. If for some reason, the connector interfaces are allowed to pull apart from each other, such as in the case of a loose F male coupler, an interface "gap" may result. This gap can be a point of an RF leak as previously described.

To overcome this issue a number of approaches have been introduced including U.S. Pat. No. 7,114,990 (Bence, et al.); U.S. Pat. No. 7,479,035 (Bence, et al.); U.S. Pat. No. 6,716,062 (Palinkas, et al.) and US Patent application 20080102696 (Montena). While these approaches have been successful in varying degrees, it is desirable to provide a functioning connector junction that will operate at various stages of engagement.

To address the issue of loosening Type F couplers a number of approaches have been introduced including a lock-washer design produced by Phoenix Communications Technologies International (PCT), known at the TRS connector. While this approach may be somewhat successful in varying degrees, it is desirable to provide a functioning connector junction that will provide an improved locking mechanism.

It would be desirable therefore to provide a coaxial cable connector that provides a connection without gapping, an alternative ground path, and a way to RF shield both ingress and egress.

SUMMARY OF THE INVENTION

Disclosed herein is coaxial cable connector for coupling an end of a coaxial cable to a terminal, the coaxial cable connector including a body, the body comprising a rear end, a front end, an external surface, and an internal surface extending between the rear and front ends of the body, the external surface having a groove, a coupler disposed proximate the front end of the body, the coupler having a front end and a back end and an opening extending therebetween, the opening having an internal surface and a channel in the internal surface, the opening receiving at least a portion of the body, and a ring having a forward facing surface and a rearward facing surface, the ring disposed in and engaging at least a portion of the groove in the body and at least a portion of the channel in the coupler, wherein radial movement of the coupler causes the axial movement of the body relative to the terminal.

In some embodiments, the coaxial cable connector includes a threaded member disposed in the opening of the coupler, the threaded member axially movable relative to the coupler and elastically biased against the front end of the body, the threaded member having a threaded opening to engage a corresponding threaded portion of the terminal.

In other embodiments, the front end of the body has fingers biased radially inward to engage a portion of the terminal.

In some embodiments, the internal surface of the coupler has a threaded portion to engage a corresponding threaded portion on a terminal.

According to another aspect of the invention, a coaxial cable connector for coupling an end of a coaxial cable to a terminal is disclosed, the coaxial cable connector includes a body, the body comprising a rear end, a front end, and an external surface, the body having a plurality of fingers at the front end of the body and the external surface having a groove and a threaded portion, a coupler disposed proximate the front end of the body, the coupler having a front end and a back end and an opening extending therebetween, the opening having an internal surface and a threaded portion in the internal surface corresponding to the threaded portion of the body, the opening receiving at least a portion of the body, and an elastic ring disposed in the opening of the coupler and adjacent the front end of the body, the elastic ring sealing the front end of the coupler when attached to the terminal.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description of the present embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the description serve to explain the principles and operations of the invention.

DETAILED DESCRIPTION OF THE PREFERRED EMBODIMENTS

Figure 1:
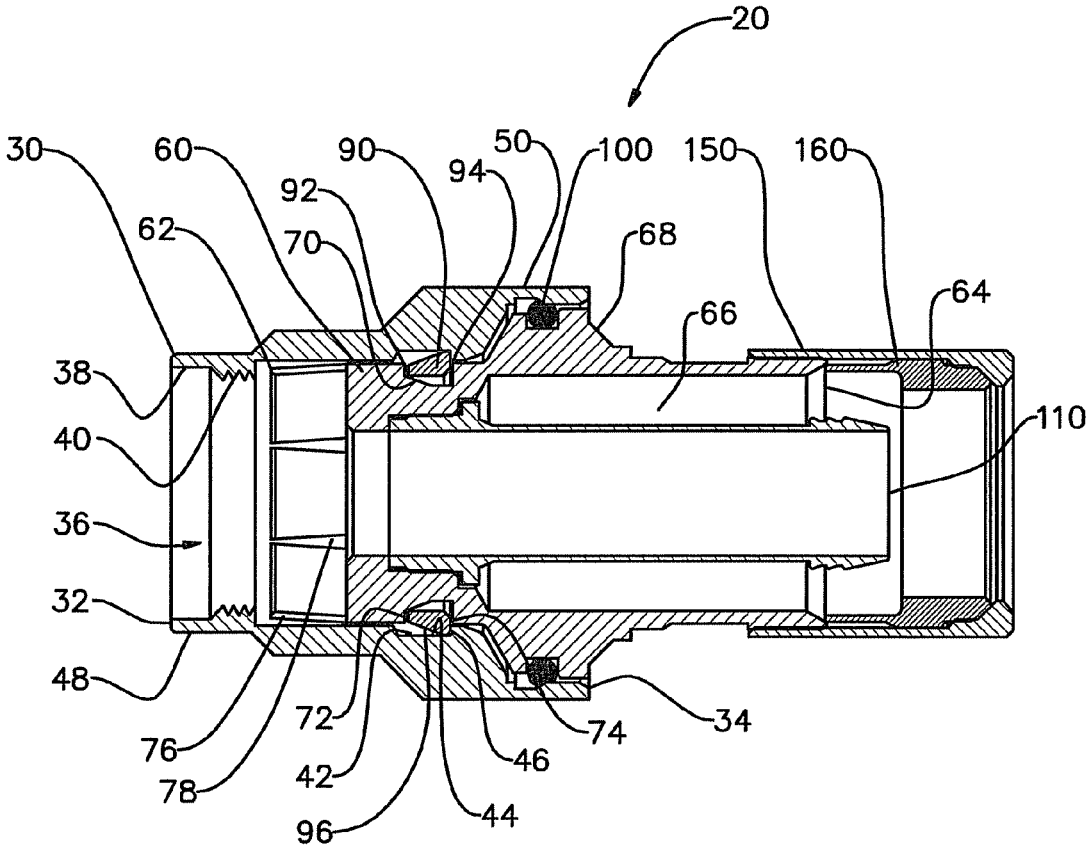
FIG. 1 is a cross-sectional view of one embodiment of a coaxial cable connector according to the present invention prior to engagement.

Reference will now be made in detail to the present preferred embodiment(s) of the invention, examples of which are illustrated in the accompanying drawings. Whenever possible, the same reference numerals will be used throughout the drawings to refer to the same or like parts.

Referring to FIG. 1, a coaxial cable connector 20 has a coupler 30, a body 60, a ring 90, a sealing member 100, a post 110, a gripping member 160, and compression ring 150. The coaxial cable connector 20 is an axial-compression type coaxial cable connector and the connection of the coaxial cable connector 20 to a coaxial cable is known in the art. The coaxial cable connector 20 is illustrated in FIG. 1 in its unattached, uncompressed state. As described in more detail below, the ring 90 is snap fit onto the body 60. The coupler 30 is then disposed over the body 60 and the ring 90. The post 110 is then press-fit into the body 60. Finally, the gripping member 160, with the compression ring 150 disposed therein, is press-fit on to the body 60 to complete the coaxial cable connector 20. The coupler 30 is free to rotate around the post 110 in the front portion of the body 60.

The coupler 30 has a front end 32, a back end 34, and an opening 36 extending there between. The opening 36 of the coupler 30 has an internal surface 38. The internal surface 38 includes a threaded portion 40 and a channel 42. The channel 42 has a bottom surface 44 and a forward facing rear surface 46. The coupler 30 also has a smooth outer surface 48 adjacent the front end 32 and a hexagonal configuration 50 adjacent the back end 34. The coupler 30 is preferably made from a metallic material, such as brass, and it is plated with a conductive, corrosion-resistant material, such as nickel.

The body 60 includes a front end 62, rear end 64, and an opening 66 extending therebetween. The body 60 also has an outer surface 68, the outer surface 68 having a groove 70 near the front end 62. The groove 70 includes a rearward facing surface 72 and a forward facing surface 74. The body 60, and in particular the front end 62, has a plurality of fingers 76. The plurality of fingers 76 have an opening or slot 78 between each of the fingers 76. The plurality of fingers 76 are biased radially inward to engage a terminal, as described in detail below. The body 60 is also made from a metallic material, such as brass, and it is also plated with a conductive, corrosion-resistant material, such as tin.

Ring 90 is preferably a c-shaped tapered cone and is disposed within both the channel 42 and the groove 70. Ring 90 has a front end 92, a back end 94, and an external taper 96 such that ring 90 increases in outside diameter between the front end 92 and the back end 94. Ring 90 engages the channel 42 at the forward facing rear surface 46 and the rearward facing surface 72 of groove 70. Ring 90 is preferably made from a metallic material, such as heat treated beryllium copper.

A sealing member 100 can be included between the coupler 30 and the body 60 to prevent the ingress of moisture and debris, allowing the coaxial cable connector 20 to be used in an outdoor environment.

Figure 2:
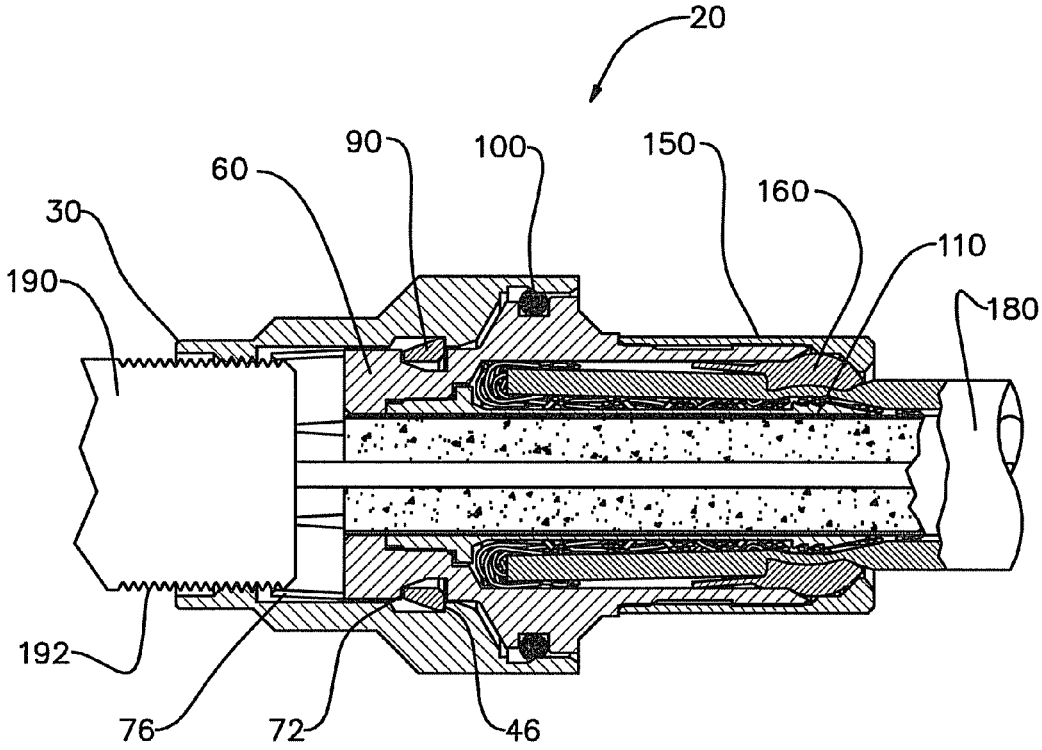
FIG. 2 is a cross-sectional view of the coaxial cable connector of FIG. 1 in partial engagement.

Turning to FIG. 2, the coaxial cable connector 20 has been installed onto a coaxial cable 180 as is known in the art. The coupler 30 of the coaxial cable connector 20 has been turned a few turns to engage a terminal 190 and, in particular, the threads 192 of the terminal 190. The fingers 76 have begun to engage the terminal 190 providing mechanical and electrical communication between the terminal 190 and coaxial cable connector 20, ensuring acceptable levels of RF performance in terms of grounding, shielding, and picture quality. As the coupler 30 of the coaxial cable connector 20 rotates and is drawn onto the terminal 190, the forward facing rear surface 46 of channel 42 engages the ring 90, which in turn engages the rearward facing surface 72 of groove 70, driving the body 60 forward so fingers 76 engage the terminal 190.

Figure 3:
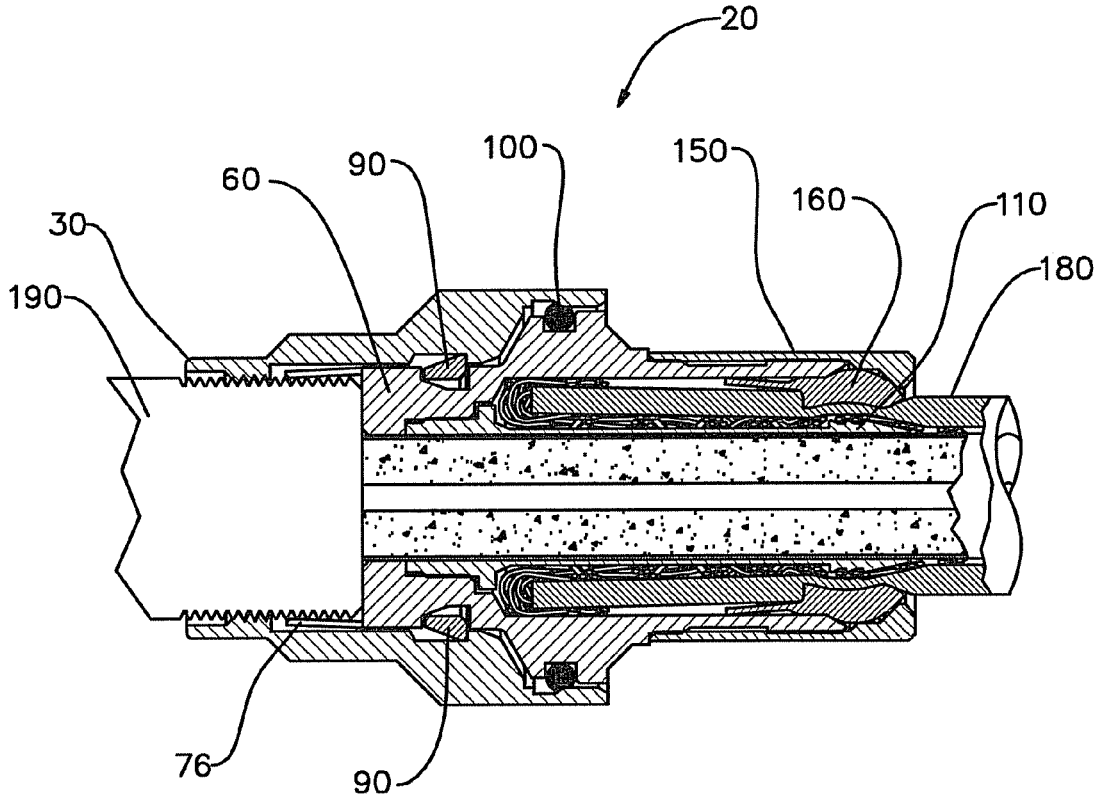
FIG. 3 is a cross-sectional view of the coaxial cable connector of FIG. 1 in full engagement.

FIG. 3 illustrates the coaxial cable connector 20 fully engaged on the terminal 190, where the terminal 190 makes physical and electrical contact with the body 60 and the cable 180. The coupler 30 has been advanced as far as it can be on terminal 190. Since the body 60 is in contact with the terminal 190, the coupler 30 can not be turned any further due to the ring 90 engaging both the body 60 and the coupler 30.

Figure 4:
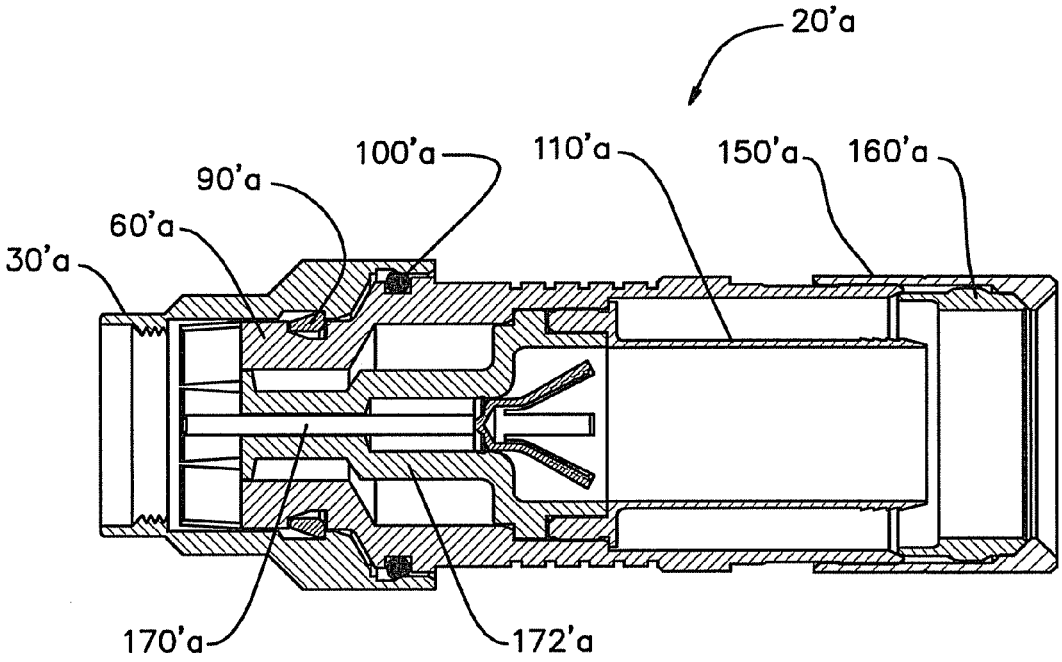
FIG. 4 is a cross-sectional view of an alternative embodiment of the coaxial cable connector of FIG. 1.

FIG. 4 illustrates an alternative embodiment of a coaxial cable connector 20'*a*. Coaxial cable connector 20'*a* includes a coupler 30'*a*, a body 60'*a*, a ring 90'*a*, a sealing member 100'*a*, a post 110'*a*, a gripping member 160'*a*, and compression ring 150'*a*. Coaxial cable connector 20'*a* also includes a pin 170'*a* that is disposed within a dielectric member 172'*a*. Although the body 60'*a* and the post 110'*a* have a slightly different configuration from coaxial cable connector 20'*a*, the function of these elements remains the same. As the coupler 30'a is rotated, the body 60'a is moved axially to engage a terminal (not shown) as discussed above. The remaining elements of coaxial cable connector 20'a also function as discussed and described above.

Figure 5:
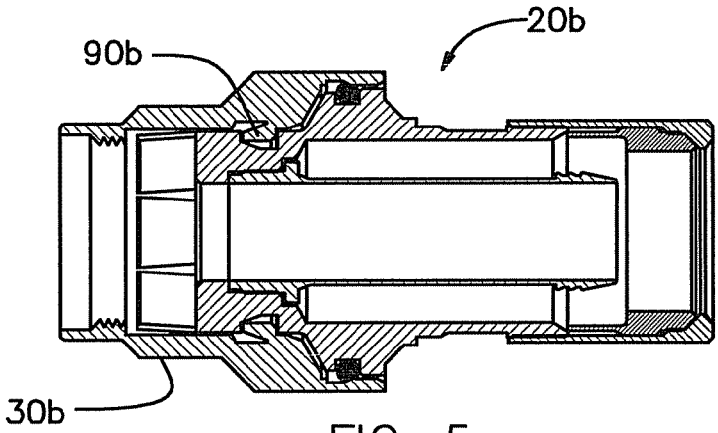
FIG. 5 is a cross-sectional view of an alternative embodiment of the coaxial cable connector of FIG. 1.

In FIG. 5, another alternative embodiment of a coaxial cable connector 20*b* is illustrated. Coaxial cable connector 20*b* has a coupler 30*b* that is preferably made from a plastic material with an integral ring 90*b*, rather than having it as an independent part of the coaxial cable connector 20*b*. The integral ring 90*b* would be molded at the same time as the coupler 30*b*.

Figure 6:
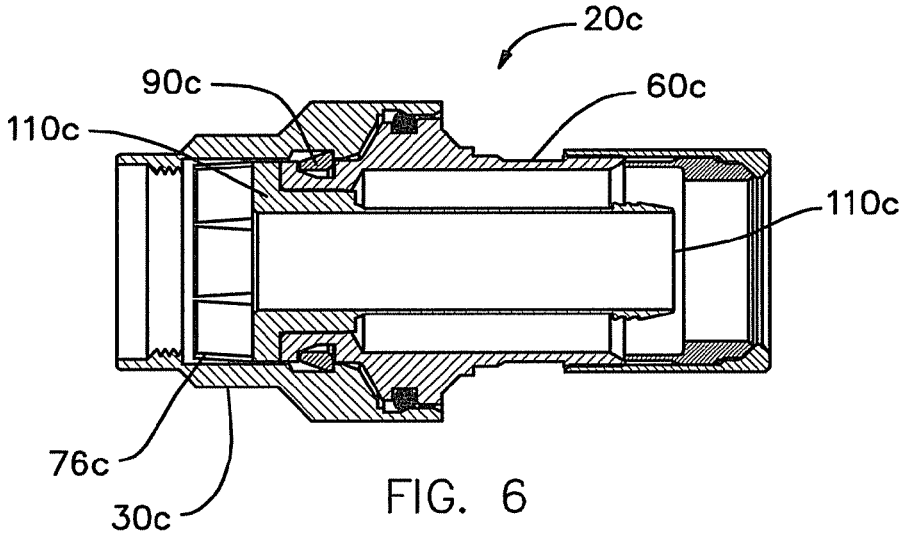
FIG. 6 is a cross-sectional view of an alternative embodiment of the coaxial cable connector of FIG. 1.

Another alternative embodiment of a coaxial cable connector 20*c* is illustrated in FIG. 6. The coaxial cable connector 20*c* has the plurality of fingers 76*c* attached to a slightly modified post 110*c* rather than being attached to the body 60*c*. The post 110*c*, having the plurality of fingers 76*c*, is press fit into the body 60*c* from the front of the body 60*c*. The coupler 30*c*, as it is rotated to engage the terminal (not shown), engages the ring 90*c*, which in turn pushes the body 60*c* and the post 110*c*.

Figure 7:
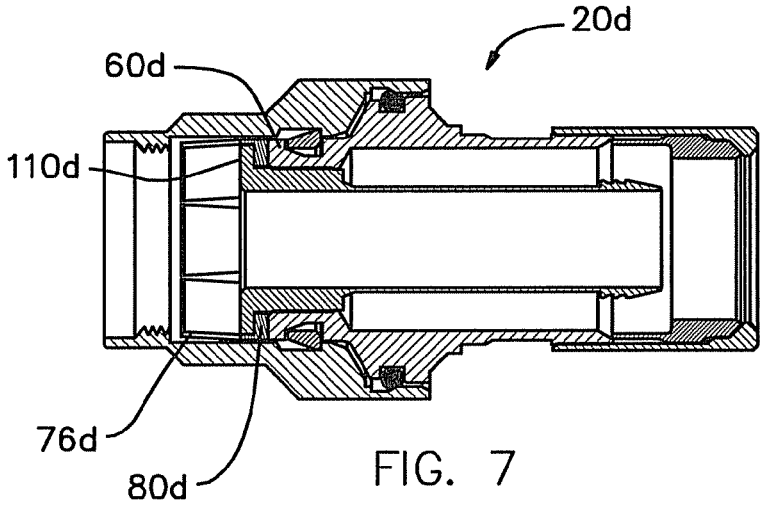
FIG. 7 is a cross-sectional view of an alternative embodiment of the coaxial cable connector of FIG. 1.

Yet another alternative embodiment of a coaxial cable connector 20*d* is illustrated in FIG. 7. In this embodiment of coaxial cable connector 20*d*, the plurality of fingers 76*d* are attached to a separate element 80*d* that is compressed between the body 60*d* and the post 110*d*. The coupler 30*d*, as it is rotated to engage the terminal (not shown), engages the ring 90*d*, which in turn pushes the post 110*d*, the element 80*d* with the plurality of fingers 76*d*, and the body 60*d*.

Figure 8:
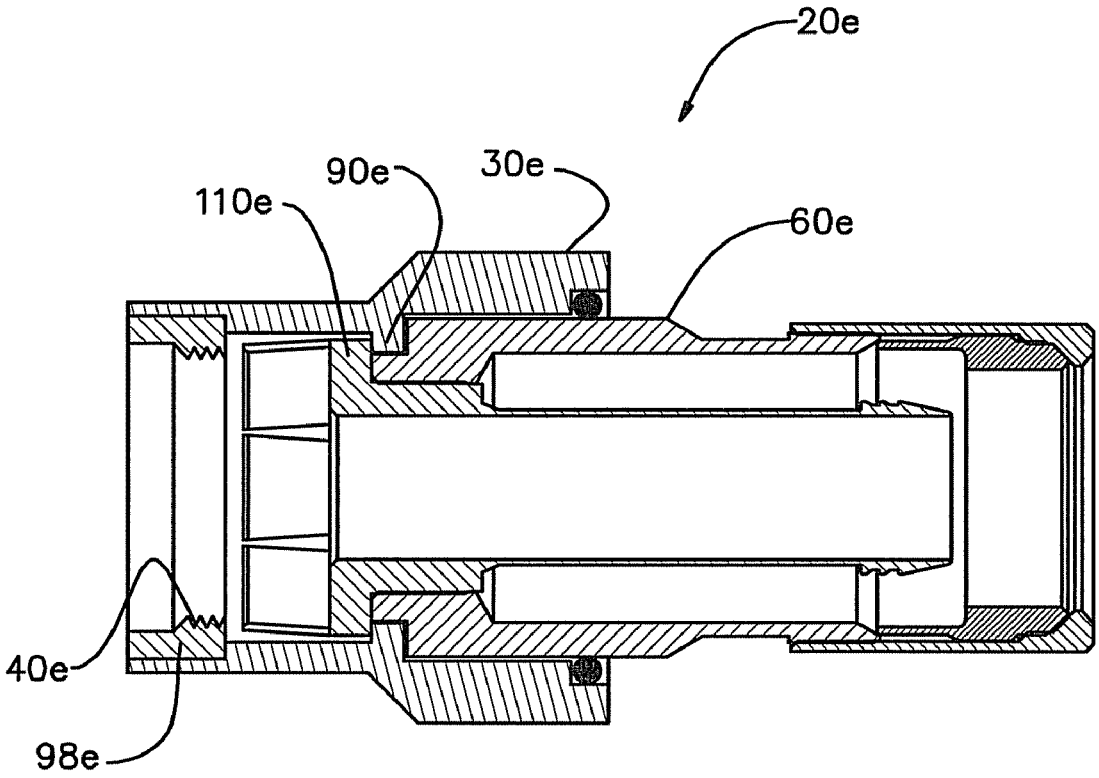
FIG. 8 is a cross-sectional view of an alternative embodiment of the coaxial cable connector of FIG. 1.

Another alternative embodiment of a coaxial cable connector 20*e* is illustrated in FIG. 8. In this embodiment of coaxial cable connector 20*e*, the coupler 30*e* has a projection 90*e* that functions as the ring from the other embodiments. The projection 90*e* engages the post 110*e* and pulls the terminal in to the coaxial cable connector 20*e* as the coupler 30*e* is rotated. It should be noted that with this configuration, the coupler 30*e* is placed on the body 60*e* and the post 110*e* is then press-fit into the body 60*e*, capturing the coupler 30*e* therebetween. To allow for this assembly, the threads 40*e* are formed into an insert 98*e*, which is press-fit into the front portion of the coupler 30*e* after the coupler 30*e*, the post 110*e* and the body 60*e* are assembled.

Figure 9:
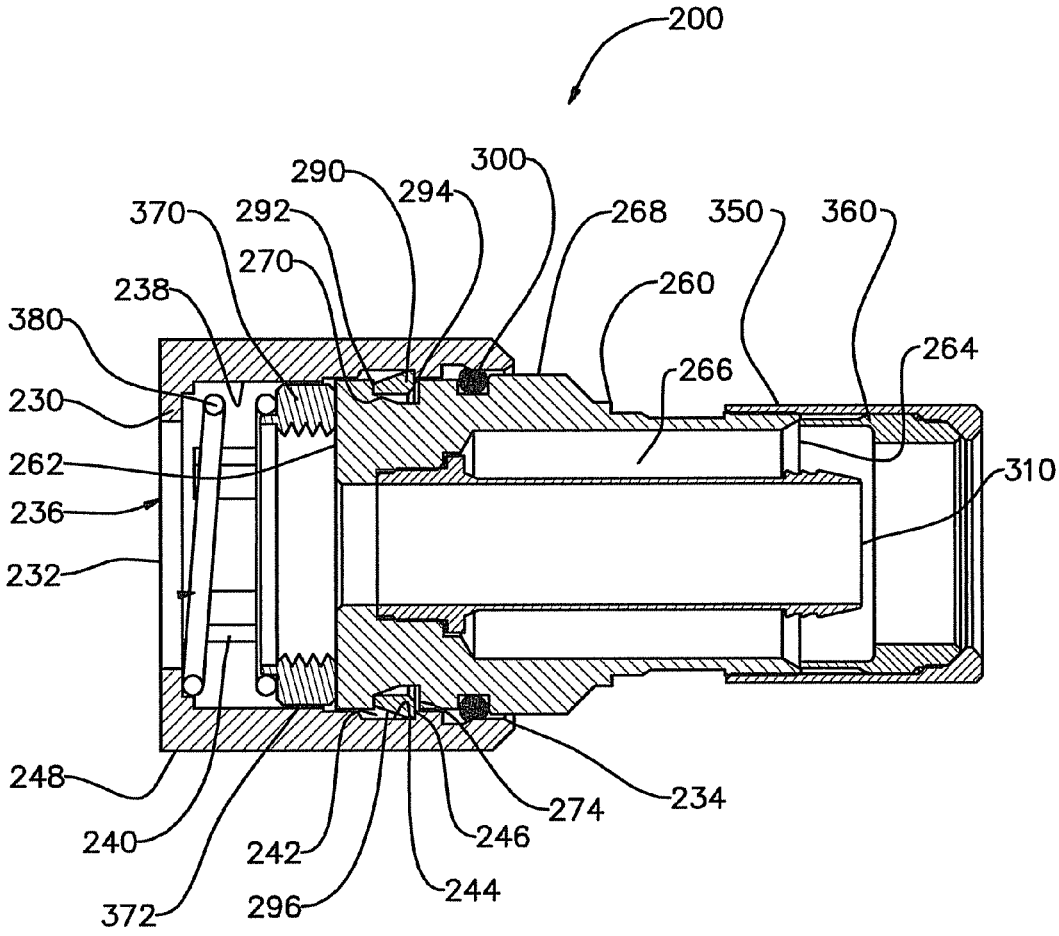
FIG. 9 is a cross-sectional view of another embodiment of a coaxial cable connector according to the present invention prior to engagement.

Another embodiment of a coaxial cable connector 200 according to the present invention is illustrated in FIG. 9. The coaxial cable connector 200 has a coupler 230, a body 260, a ring 290, a sealing member 300, a post 310, a gripping member 360, and compression ring 350. Coaxial cable connector 200 also has a threaded member 370 and a helical spring 380 disposed in the coupler 230. The coaxial cable connector 200 is an axial-compression type coaxial cable connector and the connection of the coaxial cable connector 200 to a coaxial cable is known in the art. The coaxial cable connector 200, as illustrated in FIG. 9, is in its unattached, uncompressed state.

The coupler 230 has a front end 232, a back end 234, and an opening 236 extending there between. The opening 236 of the coupler 230 has an internal surface 238. The internal surface 238 includes a hexagonal portion 240 and a channel 242. The channel 242 has a bottom surface 244 and a forward facing rear surface 246. The coupler 230 may have either a smooth outer surface 248 or hexagonal configuration. The coupler 230 is preferably made from a metallic material, such as brass, and it is plated with a conductive, corrosion-resistant material, such as nickel. The coupler 230 may alternatively be made of a plastic material.

The body 260 includes a front end 262, rear end 264, and an opening 266 extending therebetween. The body 260 also includes an outer surface 268, the outer surface 268 having a groove 270 near the front end 262. The groove 270 also includes a rearward facing surface 272 and a forward facing surface 274. The body 260 is also made from a metallic material, such as brass, and it is also plated with a conductive, corrosion-resistant material, such as tin.

Ring 290 is preferably a c-shaped tapered cone and is disposed within both the channel 242 and the groove 270. Ring 290 has a front end 292, a back end 294, and an external taper 296 such that ring 290 increases in outside diameter between the front end 292 and the back end 294. Ring 290 engages the channel 242 at the forward facing rear surface 246 and the rearward facing surface 272 of groove 270. Ring 290 is preferably made from a metallic material, such as heat treated beryllium copper.

A sealing member 300 can be included between the coupler 230 and the body 260 to prevent the ingress of moisture and debris, allowing the coaxial cable connector 200 to be used in an outdoor environment.

Threaded member 370 has an external hexagonal configuration 372 that has a sliding clearance fit with the hexagonal portion 240 of coupler 230. The sliding clearance fit of threaded member 370 permits nesting of threaded member 370 within the hexagonal portion 240 of coupler 230 while allowing axial movement of threaded member 370 within coupler 230. Further, this nesting relationship permits internal threaded member 370 to be rotatably moved by the rotation of coupler 230.

Helical spring 380 is housed within coupler 230 between the front end 232 and the threaded member 370. The helical spring 380 biases the threaded member 370 into intimate contact with body 260. Helical spring 380 is preferably made from a heat treated spring steel and is preferably in a coil type arrangement as illustrated, but may alternately be constructed of a plastic material. As a further alternate configuration, helical spring 380 may be formed in stamped, flattened shape such as a wave washer or conical configuration.

Figure 10:
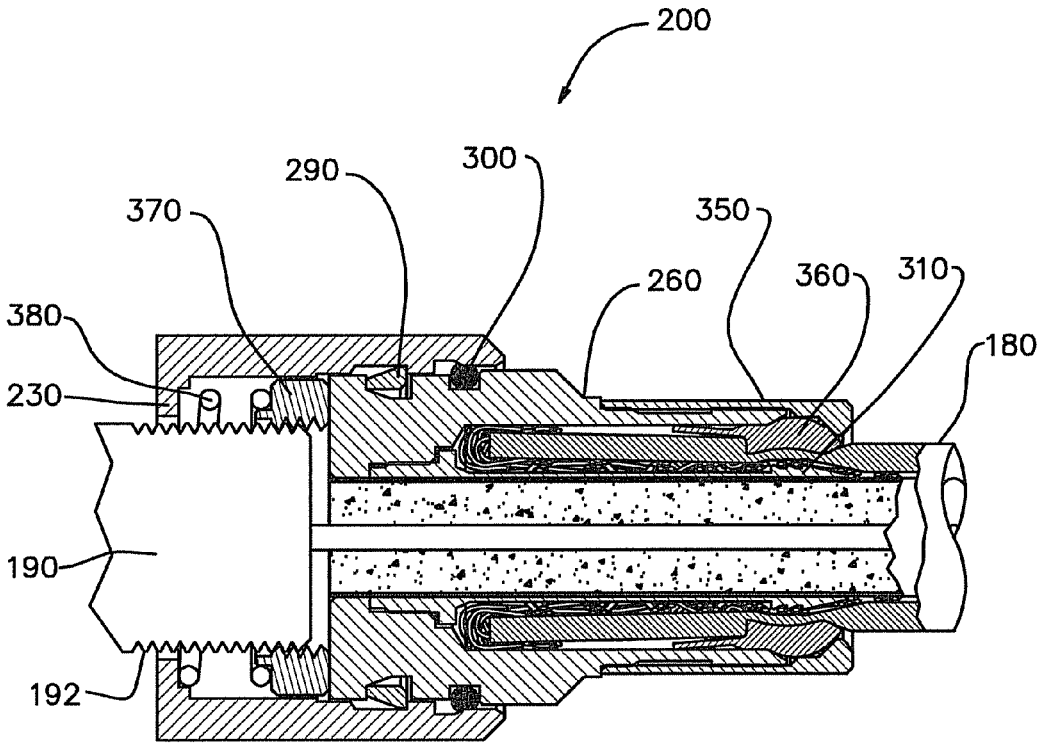
FIG. 10 is a cross-sectional view of the coaxial cable connector of FIG. 9 in partial engagement.
Figure 11:
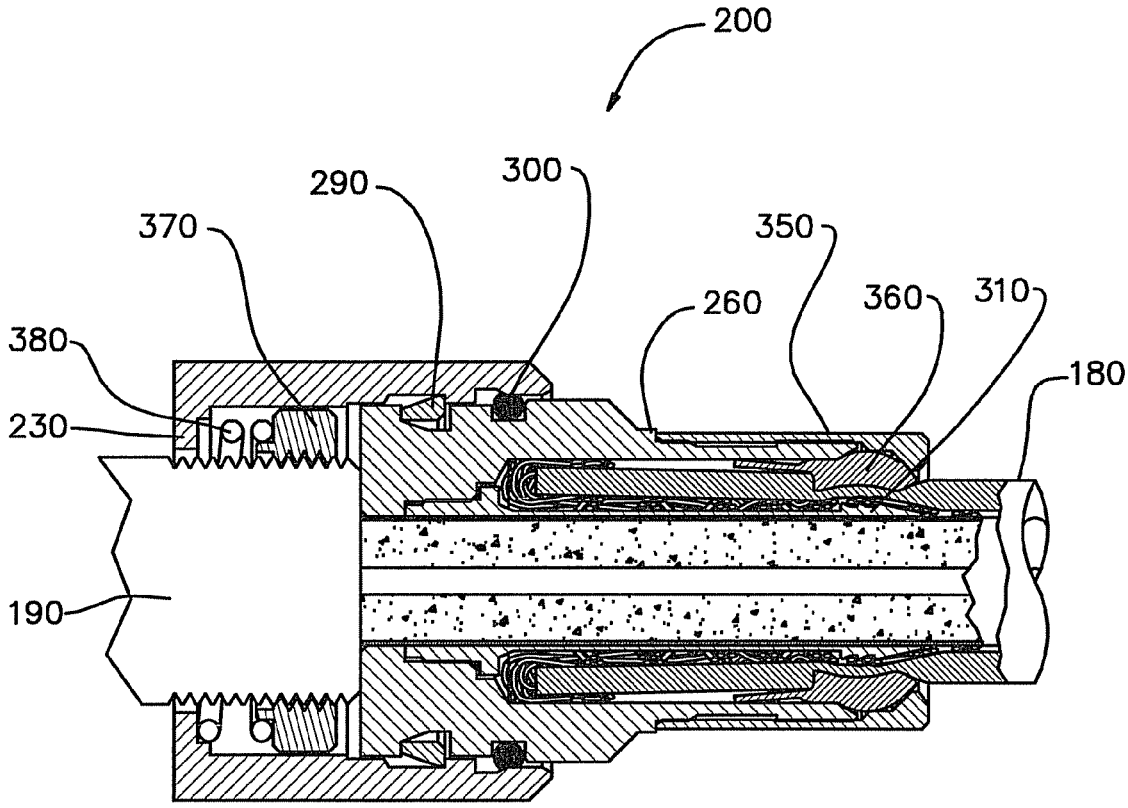
FIG. 11 is a cross-sectional view of the coaxial cable connector of FIG. 9 in full engagement.

As illustrated in FIG. 10, the terminal 190 has been inserted through the opening 236 at the front end 232 of a coupler 230 where the threaded member 370 has been rotated by the rotation of coupler 230 and has engaged the terminal 190 and, more specifically, the threads 192. A coaxial cable 180 has been installed on the coaxial cable connector 200. The helical spring 380 biases the threaded member 370 against the body 260. As the coupler 230 is rotated (and rotating the threaded member 370), the terminal 190 engages even more of the body 260. See FIG. 11. As the coupler 230 is further rotated, the threaded member 370 moves along the terminal 190 towards the front end 232 of the coupler 230. The relative positions of the coupler 230 and the body 260 remain the same during rotation of the coupler 230 because of the ring 290. Ring 290 allows the coupler 230 to rotate about the body 260, but rather than the body 260 moving axially to engage the terminal 190, the threaded member 370 moves. With helical spring 380 positioned between the threaded member 270 and the front end 232 of the coupler, an increasing force on the threaded member 370, due to compression of the spring 380, keeps the terminal 190 in contact with the body 260.

Figure 12:
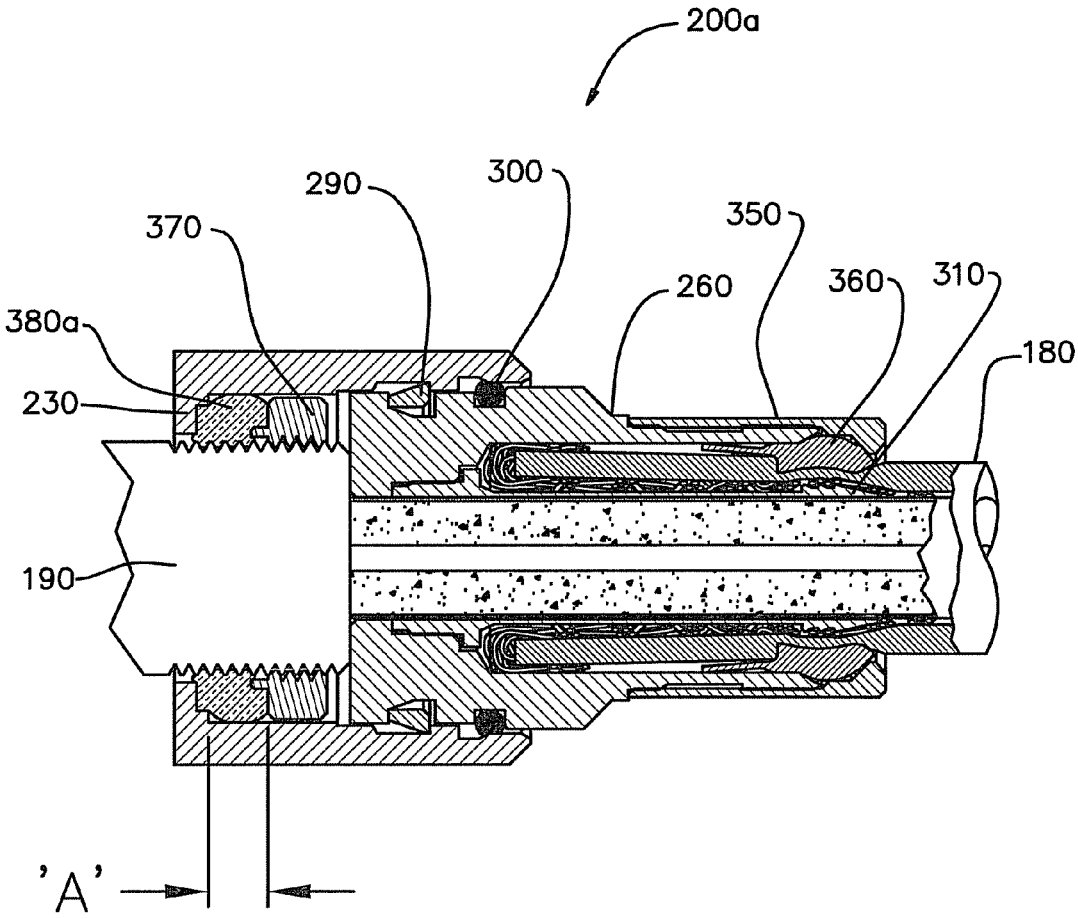
FIG. 12 is a cross-sectional view of an alternative embodiment of the coaxial cable connector of FIG. 9.

As a further alternate configuration, helical spring 380 may be constructed from a rubber material or conductive rubber material thus providing a combination of spring force, environmental sealing characteristics, RF sealing characteristics, and/or electrical grounding functions as illustrated as ring spring 380*a* in FIG. 12. The ring spring 380*a* is constructed from a rubber material or a conductive rubber and is illustrated in FIG. 12 and a compressed or activated condition. As the coupler 230 is rotated and the threaded member 370 is advanced along the terminal 190, the gap "A" is reduced and the ring spring 380*a* provides a number of advantages. First, the ring spring 380*a* fills the space between the threaded member 370, the front end 232 of the coupler 230, and the terminal 190. The ring spring 380*a* also provides environmental sealing of the coaxial cable connector 200*a*, RF sealing characteristics, electrical grounding functions, and an increased resistance to axial movement of the coupler 230 and the threaded member 370.

Figure 13:
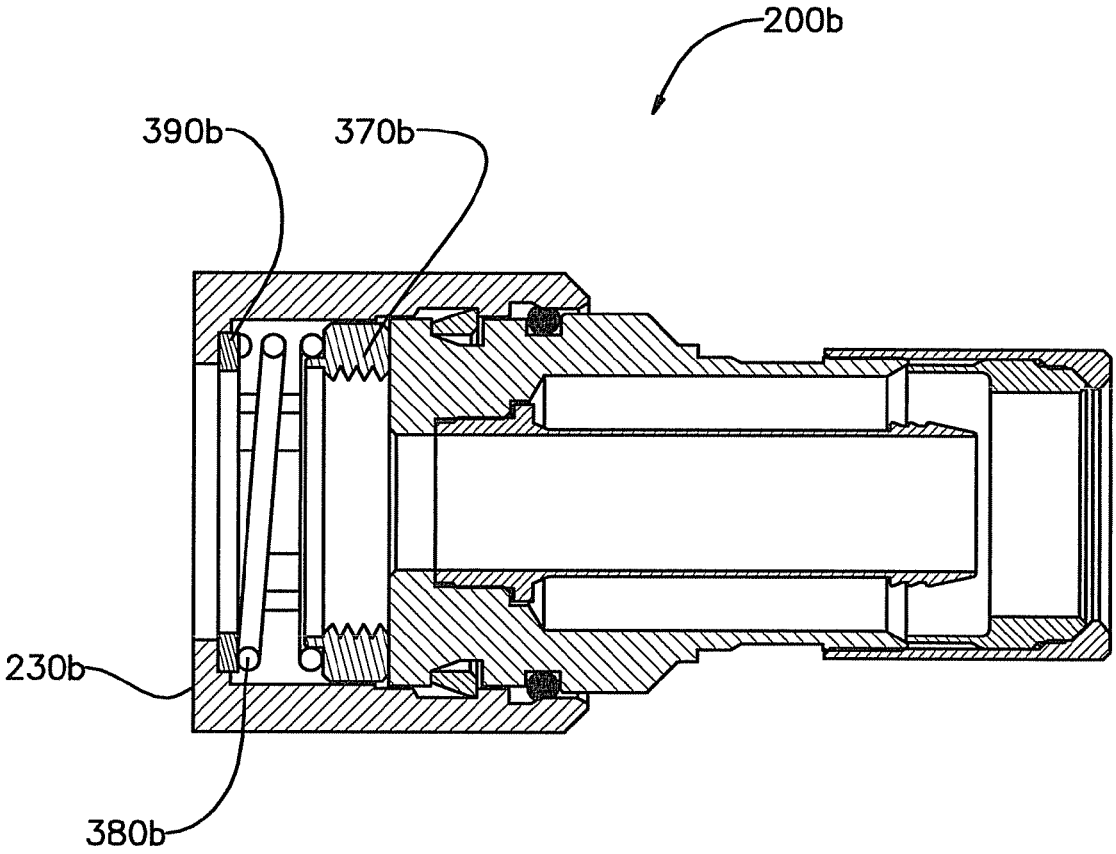
FIG. 13 is a cross-sectional view of an alternative embodiment of the coaxial cable connector of FIG. 9.

FIG. 13 illustrates an alternative embodiment of a coaxial cable connector 200*b*. In coaxial cable connector 200*b*, a washer 390*b* is disposed between the front of the coupler 230*b* and the helical spring 380*b*, which is biased against the threaded member 370*b*.

Figure 14:
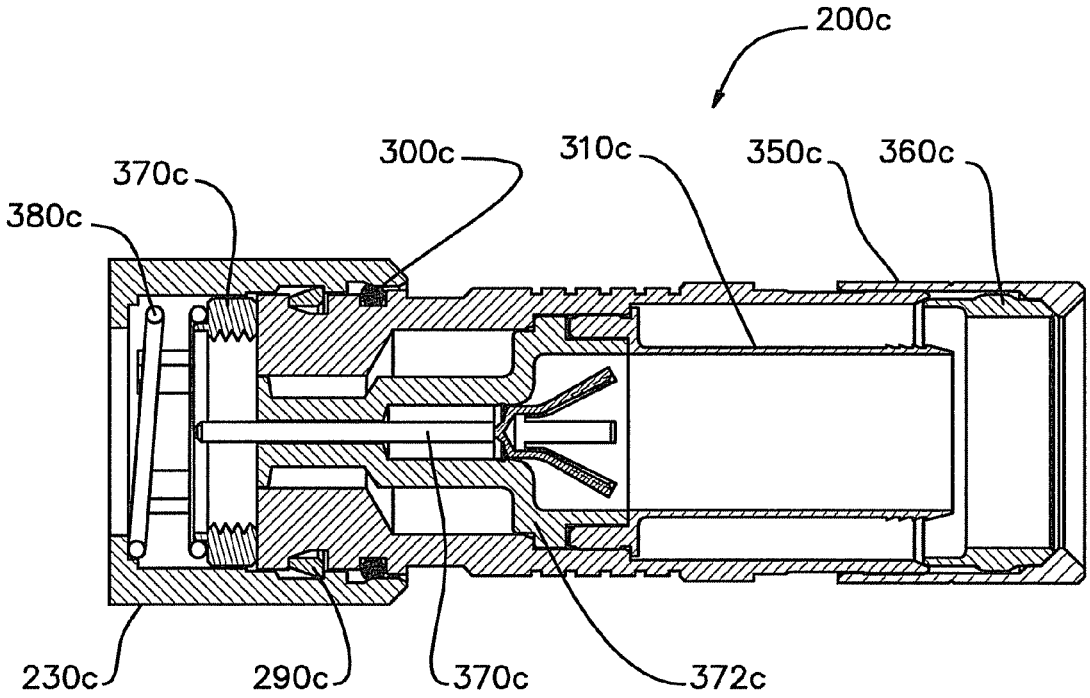
FIG. 14 is a cross-sectional view of an alternative embodiment of the coaxial cable connector of FIG. 9.

FIG. 14 illustrates an alternative embodiment of a coaxial cable connector 200*c*. Coaxial cable connector 200*c* includes a coupler 230*c*, a body 260*c*, a ring 290*c*, a sealing member 300*c*, a post 310*c*, a gripping member 360*c*, compression ring 350*c*, and a threaded member 370*c* and a helical spring 380*c* disposed in the coupler 230*c*. Coaxial cable connector 200*c* also includes a pin 370*c* that is disposed within a dielectric member 372*c*, both of which are disposed within the body 260*c*. Although the body 260*c* and the post 310*c* have a slightly different configuration from coaxial cable connector 200, the function of these elements remains the same. As the coupler 230*c* is rotated, the body 260*c* maintains contact with the terminal (not shown) as discussed above. The remaining elements of coaxial cable connector 200*c* also function as discussed and described above.

Figure 15:
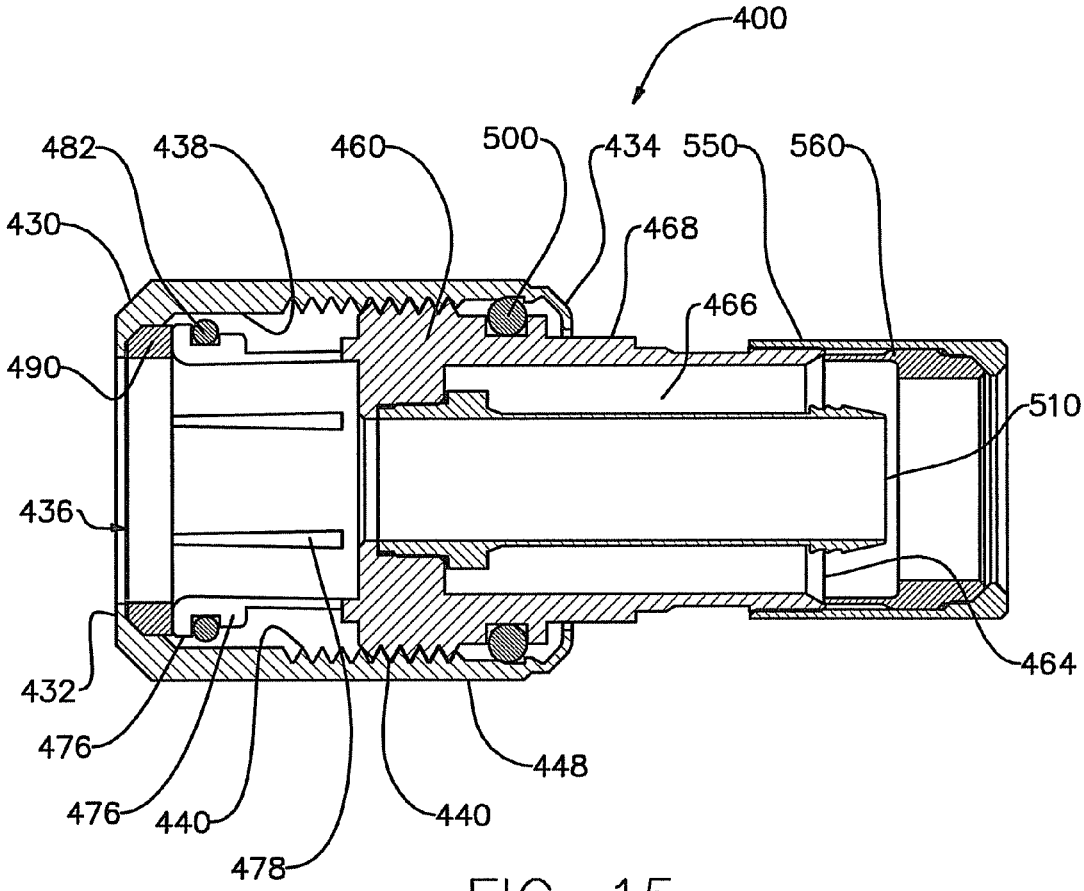
FIG. 15 is a cross-sectional view of another embodiment of a coaxial cable connector according to the present invention prior to engagement.

Another embodiment of the coaxial cable connector 400 according to the present invention is illustrated in FIG. 15. The coaxial cable connector 400 has a coupler 430, a body 460, a ring 490, a sealing member 500, a post 510, a gripping member 560, and a compression ring 550. This connector is also an axial-compression type coaxial cable connector and the connection of the coaxial cable connector 400 to a coaxial cable is known in the art.

The coupler 430 has a front end 432, a back end 434, and an opening 436 extending therebetween. The opening 436 of the coupler 430 has an internal surface 438. The internal surface 438 includes a threaded portion 440. Threaded portion 440 and the corresponding threads on the body 460 are preferably left-handed. The back end 434 is preferably rolled-over toward the body 460 to prevent the coupler 430 from being rotated off the front of the coaxial cable connector 400. The coupler 430 may have either a smooth outer surface 448 or hexagonal configuration. The coupler 430 is preferably made from a metallic material, such as brass, and it is plated with a conductive, corrosion-resistant material, such as nickel. The coupler 430 may alternatively be made of a plastic material.

The body 460 includes a front end 462, rear end 464, and an opening 466 extending therebetween. The body 460 also includes an outer surface 468. The body 460 has at its front end 462 a plurality of fingers 476, between each of the fingers 476 is an opening or slot 478. The front end 462 and the plurality of fingers 476 are encircled by a circlip or a snap ring 482. The snap ring 482 may be constructed from a metallic material such as heat-treated spring steel or, alternatively, from a rubber material or conductive rubber material, thus providing a combination environmental sealing characteristics, RF sealing characteristics, and/or electrical grounding functions. The body 460 is also made from a metallic material, such as brass, and it is also plated with a conductive, corrosion-resistant material, such as tin.

A sealing member 500 can be included between the coupler 430 and the body 460 to prevent the ingress of moisture and debris, allowing the coaxial cable connector 400 to be used in an outdoor environment.

The ring 490 is disposed between the front end of 462 of the body 460 and the front end 432 of the coupler 430. Ring 490 is constructed from a rubber material or a conductive rubber and is illustrated in FIG. 15 in an uncompressed or un-activated condition.

Figure 16:
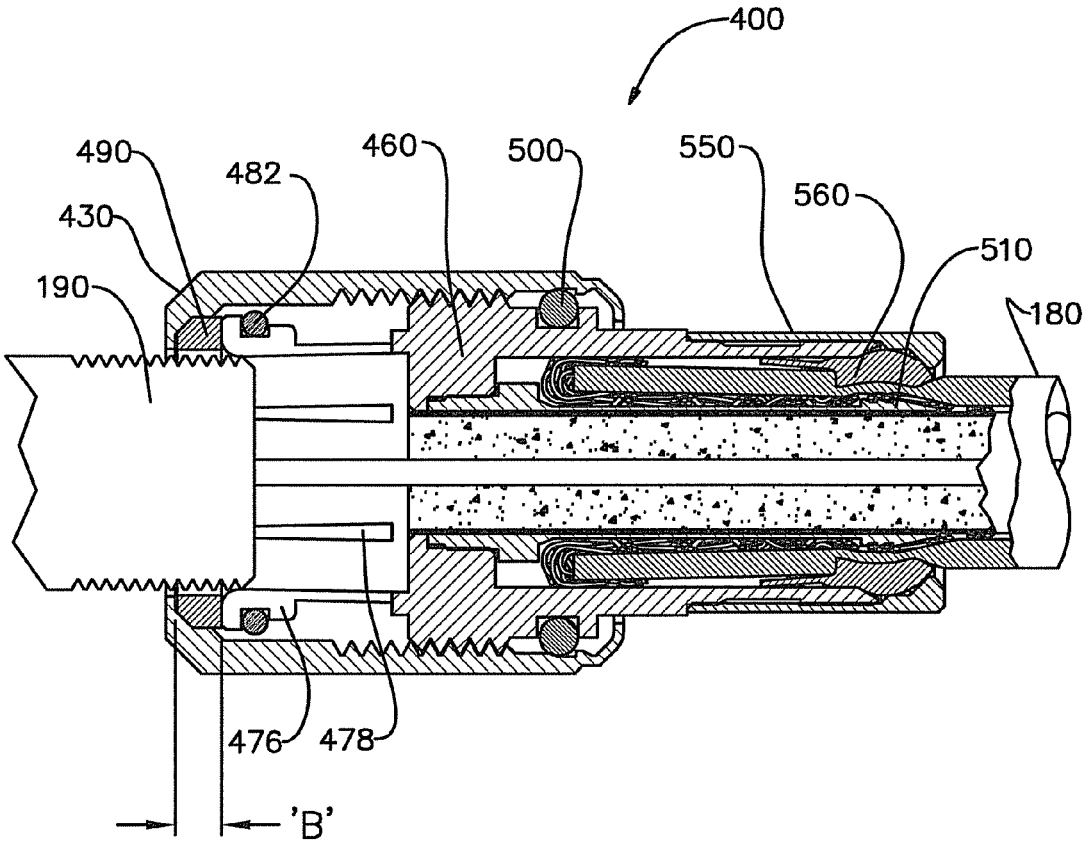
FIG. 16 is a cross-sectional view of the coaxial cable connector of FIG. 15 in partial engagement.

As illustrated in FIG. 16, the terminal 190 has been inserted through the opening 436 at the front end 432 of a coupler 430 where the fingers 476 have engaged the terminal 190, and more specifically, the threads 192. A coaxial cable 180 has been installed on the coaxial cable connector 400. The circlip or a snap ring 482 biases the fingers 476 against the terminal 190. The ring 490 fills the gap "B" as illustrated in FIG. 16. However, after the terminal 190 is inserted into the coupler 430 and as the coupler 430 is rotated (using the left-handed threads), the gap "B" is reduced as the ring 490 fills the space between the front end 432 of the coupler 430, the front end 462 of the body 460, and the terminal 190. See FIG. 17. The ring 490 may also provide environmental sealing of the coaxial cable connector 400, RF sealing characteristics, electrical grounding functions, and an increased resistance to axial movement of the coupler 430.

Figure 17:
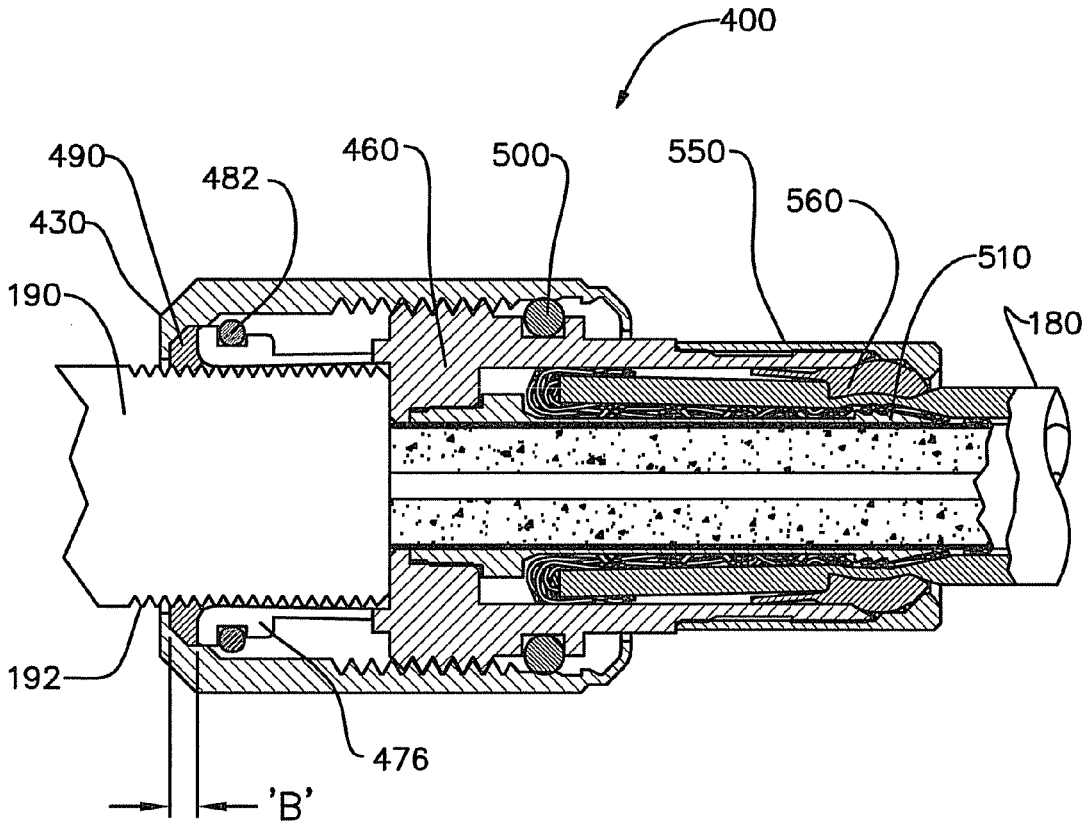
FIG. 17 is a cross-sectional view of the coaxial cable connector of FIG. 15 in full engagement.

As the coupler 430 is further rotated as illustrated in FIG. 17, the front end 432 of the coupler 430 moves backward relative to the front end 462 of the body 460 and the terminal 190. This causes the front end 462 of the body 460, and in particular the fingers 476, engage the front end 432 of the coupler 430 forcing the fingers 476 radially inward to apply even more pressure on the terminal 190.

Figure 18:
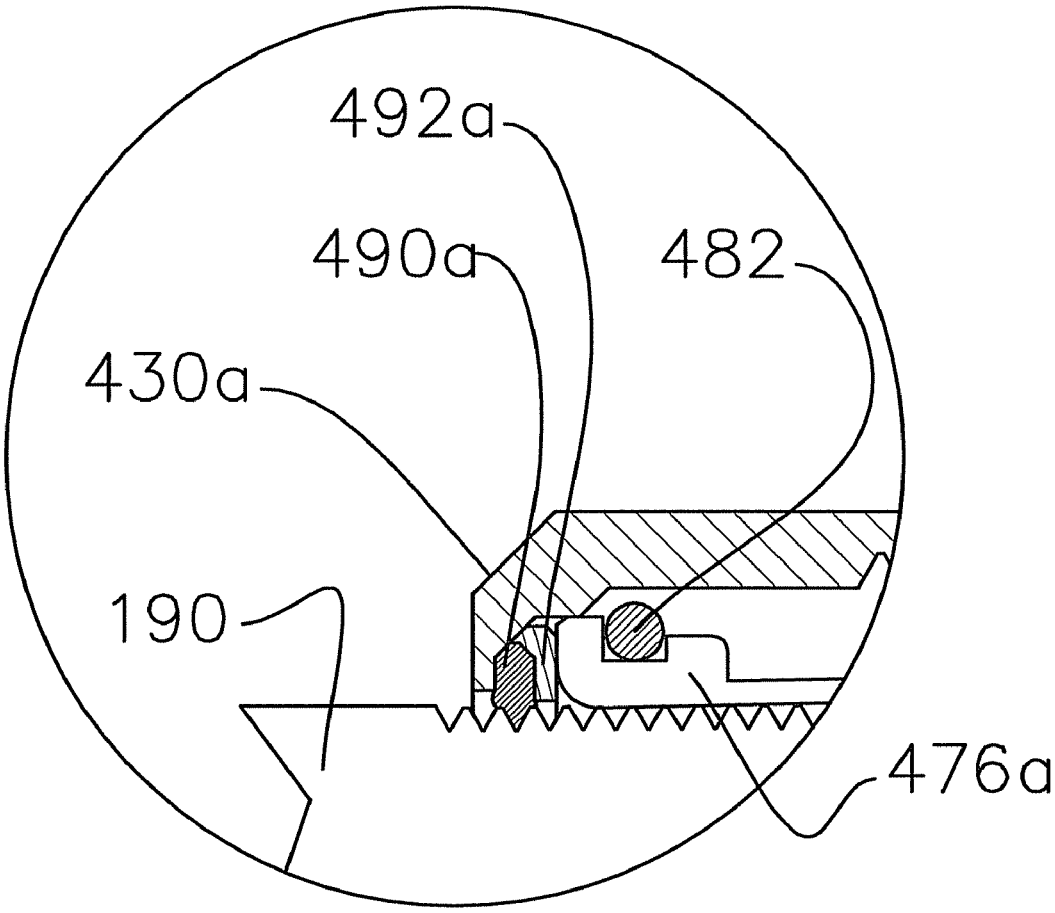
FIG. 18 is a partial cross-sectional view of an alternative embodiment of the coaxial cable connector of FIG. 15.

An alternative embodiment of coaxial cable connector 400*a* is partially illustrated in FIG. 18. The coaxial cable connector 400*a* has a coupler 430*a* and fingers 476*a* that engage the terminal 190. A ring 490*a* is also disposed between the coupler 430*a* and the fingers 476*a*. However, a backing ring 492*a* is positioned between the ring 490*a* and the fingers 476*a*, and assists in keeping the ring 490*a* from entering the opening or slots 478 between the fingers 476*a*. The backing ring 492*a* is preferably made of metal, such as brass, and plated with a conductive, corrosion-resistant material, such as nickel.

Figure 19:
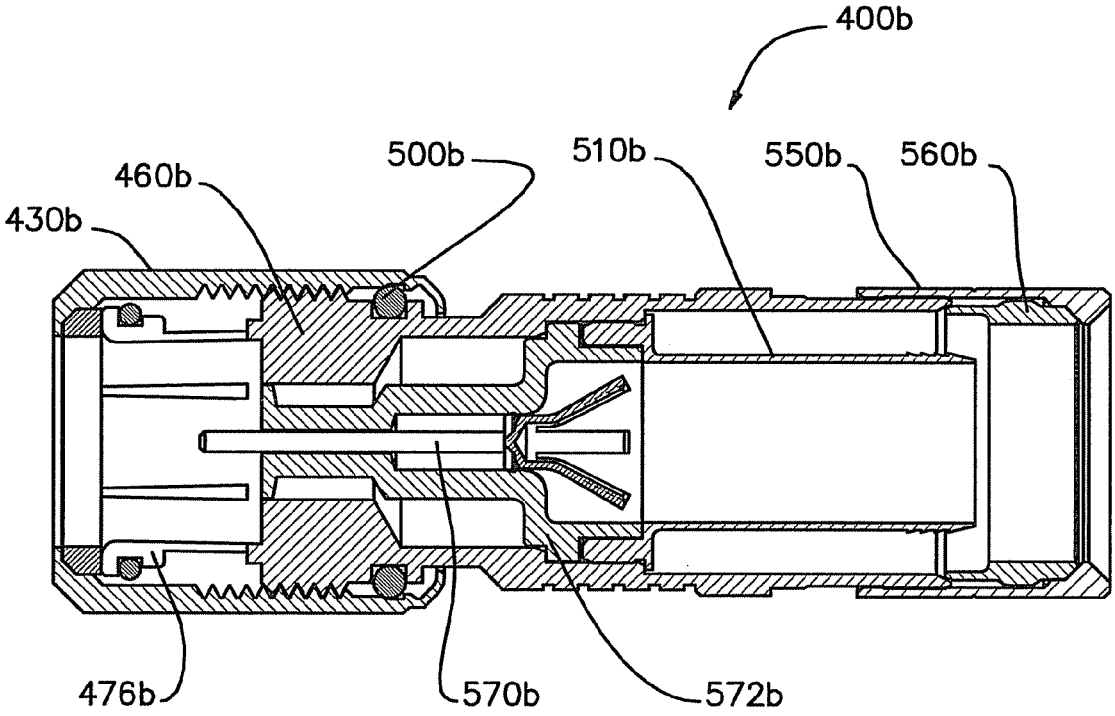
FIG. 19 is a cross-sectional view of an alternative embodiment of the coaxial cable connector of FIG. 15.

FIG. 19 illustrates yet another alternative embodiment of a coaxial cable connector 400*b*. The coaxial cable connector 400*b* has a coupler 430*b*, a body 460*b*, a sealing member 500*b*, a post 510*b*, a gripping member 560*b*, and a compression ring 550*b*. Coaxial cable connector 400*b* also includes a pin 570*b* that is disposed within a dielectric member 572*b*, both of which are disposed within the body 460*b*. Although the body 460*b* and the post 410*b* have a slightly different configuration from coaxial cable connector 400, the function of these elements remains the same. As the coupler 430*b* is rotated, the plurality of fingers 476*b* maintain contact with the terminal (not shown) as discussed above. The remaining elements of coaxial cable connector 400*b* also function as discussed and described above.

Figure 20:
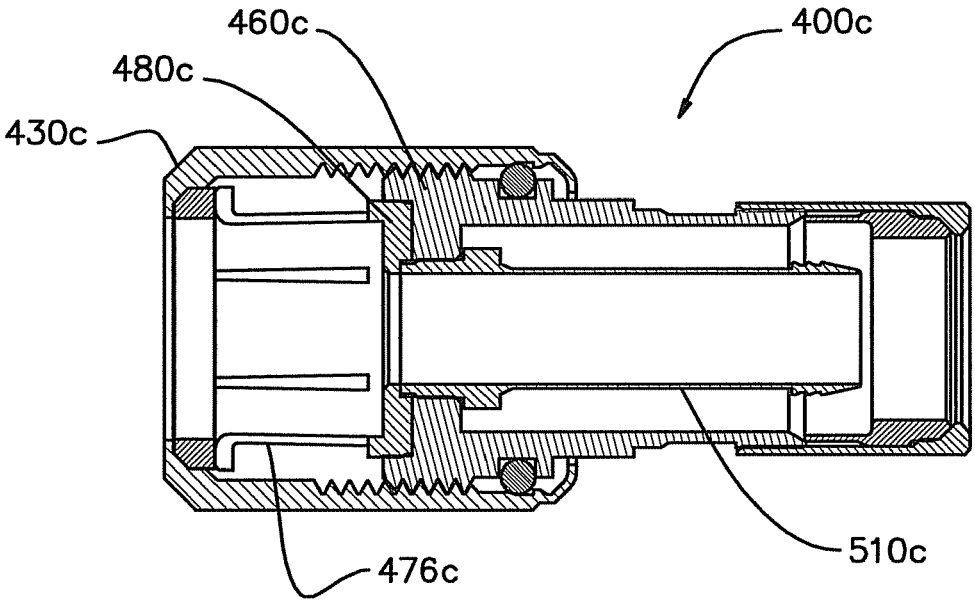
FIG. 20 is a cross-sectional view of an alternative embodiment of the coaxial cable connector of FIG. 15.

Another alternative embodiment of a coaxial cable connector 400*c* is illustrated in FIG. 20. In coaxial cable connector 400*c*, the plurality of fingers 476*c* are attached to a separate element 480*c*, which is then press fit into the front of the body 460*c*. The post 510*c* may also partially engage the separate element 480*c*, having also been press fit into the body 460*c*. As the coupler 430*c* is rotated, it engages the body 460*c*, which moves the separate element 480*c* (and also the post 510*c*) forward so the plurality of fingers 476*c* engage the front of the coupler 430*c* in the same manner as discussed above. The plurality of fingers 476*c* are preferably made with heat-treated beryllium copper, which makes the plurality of fingers

476*c* more elastic and eliminates the need for the circlip or snap ring of the prior embodiments.

Figure 21:
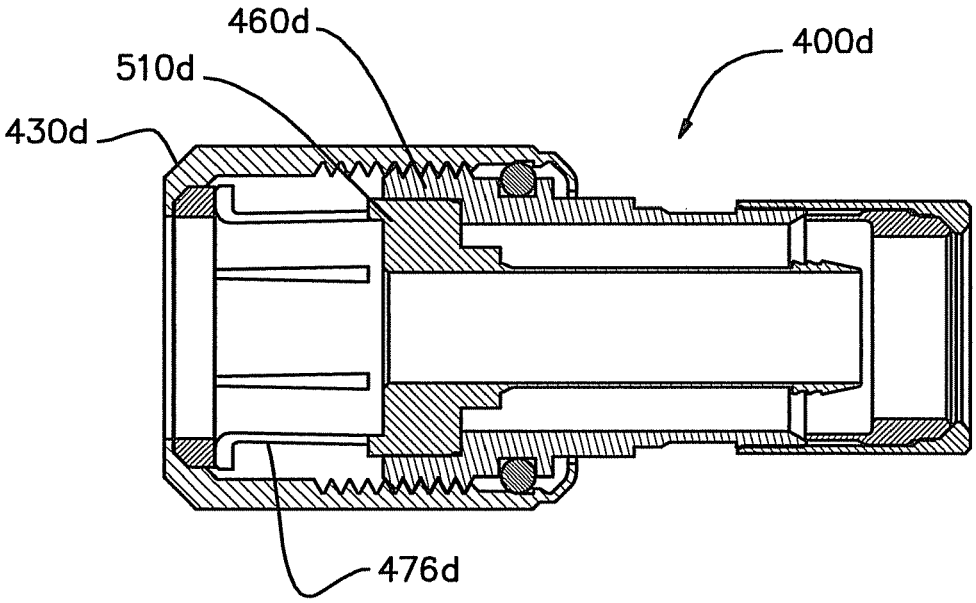
FIG. 21 is a cross-sectional view of an alternative embodiment of the coaxial cable connector of FIG. 15.

Yet another alternative embodiment of a coaxial cable connector 400*d* is illustrated in FIG. 21. In coaxial cable connector 400*d*, the plurality of fingers 476*d* are attached to the post 510*d*, which is press fit into the body 460*d*. The coupler 430*d*, as it is rotated to engage the terminal (not shown), moves the body 460*d* forward, which also moves the post 510*d* forward so the plurality of fingers 476*d* engage the front of the coupler 430*d* as in the other embodiments. The plurality of fingers 476*d* are preferably made with heat-treated beryllium copper, which makes the plurality of fingers 476*d* more elastic and eliminates the need for the circlip or snap ring.

It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents.

What is claimed is:

1. A coaxial cable connector for coupling an end of a coaxial cable to a terminal, the coaxial cable connector comprising:

a body, the body comprising a rear end, a front end, an external surface, and an internal surface extending between the rear and front ends of the body, the external surface having a groove, the front end of the body having fingers biased radially inward to engage a portion of the terminal;

a coupler disposed proximate the front end of the body, the coupler having a front end and a back end and an opening extending therebetween, the opening having an internal surface and a channel in the internal surface, the opening receiving at least a portion of the body; and a ring having a forward facing surface and a rearward facing surface, the ring disposed in and engaging at least a portion of the groove in the body and at least a portion of the channel in the coupler, wherein rotational movement of the coupler causes the axial movement of the body relative to the terminal.

2. The coaxial cable connector according to claim 1, further comprising a threaded member disposed in the opening of the coupler, the threaded member axially movable relative to the coupler and elastically biased against the front end of the body, the threaded member having a threaded opening to engage a corresponding threaded portion of the terminal.

3. The coaxial cable connector according to claim 2, further comprising an elastic ring disposed between the threaded member and the front end of the body to elastically bias the threaded member toward the body.

4. The coaxial cable connector according to claim 2, wherein the internal surface of coupler engages at least a portion of an outer surface of the threaded member, wherein rotation of the coupler about the body causes rotation of the threaded member.

5. The coaxial cable connector according to claim 1, further comprising a sealing member disposed between the coupler and the body.

6. The coaxial cable connector according to claim 1, the internal surface of the coupler having a threaded portion to engage a corresponding threaded portion on a terminal.

7. The coaxial cable connector according to claim 6, wherein rotation of the coupler when engaging a terminal draws the terminal into physical and electrical contact with the body.

* * * * *